US011312557B2

(12) United States Patent
Lohmeier et al.

(10) Patent No.: US 11,312,557 B2
(45) Date of Patent: Apr. 26, 2022

(54) CONTAINER WITH PRESSURE ACCOMMODATION PANEL

(71) Applicant: PepsiCo, Inc., Purchase, NY (US)

(72) Inventors: Michael Andrew Lohmeier, Chicago, IL (US); Toby Richard David Wingfield, Crystal Lake, IL (US); Lori Evans Bartman, Sylvania, OH (US); Robert Jon Groll, Oregon, OH (US)

(73) Assignee: PepsiCo, Inc., Purchase, NY (US)

( * ) Notice: Subject to any disclaimer, the term of this patent is extended or adjusted under 35 U.S.C. 154(b) by 413 days.

(21) Appl. No.: 16/413,235

(22) Filed: May 15, 2019

(65) Prior Publication Data

US 2019/0263577 A1 Aug. 29, 2019

Related U.S. Application Data

(63) Continuation of application No. 15/019,806, filed on Feb. 9, 2016, now Pat. No. 10,336,524.

(51) Int. Cl.
*B65D 79/00* (2006.01)

(52) U.S. Cl.
CPC .. *B65D 79/0084* (2020.05); *B65D 2501/0036* (2013.01)

(58) Field of Classification Search
CPC ..... B65D 1/0223; B65D 2501/0018; B65D 79/005
See application file for complete search history.

(56) References Cited

U.S. PATENT DOCUMENTS

| | | | |
|---|---|---|---|
| 5,178,289 | A | 1/1993 | Krishnakumar et al. |
| 5,341,946 | A | 8/1994 | Vailliencourt et al. |
| 6,062,409 | A | 5/2000 | Eberle |
| 6,827,228 | B2 | 7/2004 | Headen et al. |
| 6,796,450 | B2 | 9/2004 | Prevot et al. |
| 7,159,729 | B2 | 1/2007 | Sabold et al. |
| 7,198,165 | B2 | 4/2007 | Zhang |
| D547,664 | S | 7/2007 | Davis et al. |
| 7,694,842 | B2 | 4/2010 | Melrose |

(Continued)

FOREIGN PATENT DOCUMENTS

| | | |
|---|---|---|
| CN | 1299327 A | 6/2001 |
| EP | 1 002 732 A1 | 5/2000 |

(Continued)

OTHER PUBLICATIONS

International Search Report issued in International Patent Application No. PCT/US2017/015798 dated Apr. 21, 2017, 2 pages.

*Primary Examiner* — Andrew T Kirsch
(74) *Attorney, Agent, or Firm* — Sterne, Kessler, Goldstein & Fox P.L.L.C.

(57) ABSTRACT

A container is provided with a body portion. The body portion includes a first vacuum panel, a second vacuum panel, a third vacuum panel, a first diagonal column between the first vacuum panel and the second vacuum panel, and a second diagonal column between the second vacuum panel and the third vacuum panel. The second vacuum panel and the third vacuum panel are oriented in opposite directions. In response to a change in an internal container pressure, the body portion flexes at the first vacuum panel such that a surface of the first vacuum panel increases in concavity in response to an increasing pressure change.

20 Claims, 43 Drawing Sheets

(56) References Cited

U.S. PATENT DOCUMENTS

| | | | |
|---|---|---|---|
| 7,748,552 | B2 | 7/2010 | Livingston et al. |
| D630,105 | S | 1/2011 | Bourne |
| 8,087,525 | B2 | 1/2012 | Kelley et al. |
| 8,109,398 | B2 | 2/2012 | Lewis et al. |
| 8,113,369 | B2 | 2/2012 | Mast et al. |
| 8,113,370 | B2 | 2/2012 | Zhang et al. |
| 8,181,805 | B2 | 5/2012 | Barker et al. |
| D669,358 | S | 10/2012 | Sandoval et al. |
| 8,505,757 | B2 | 8/2013 | Philip et al. |
| 8,529,975 | B2 | 9/2013 | Trude et al. |
| 8,561,821 | B2 | 10/2013 | Harris et al. |
| 8,616,395 | B2 | 12/2013 | Patcheak et al. |
| 8,727,152 | B2 | 5/2014 | Strasser et al. |
| 8,813,996 | B2 | 8/2014 | Steih et al. |
| 8,881,922 | B2 | 11/2014 | Schlies et al. |
| 8,905,253 | B2 | 12/2014 | Mooney |
| 2001/0030166 | A1 | 10/2001 | Ozawa et al. |
| 2003/0015491 | A1 | 1/2003 | Melrose et al. |
| 2006/0157439 | A1 | 7/2006 | Howell |
| 2006/0289378 | A1 | 12/2006 | Zhang |
| 2007/0187355 | A1 | 8/2007 | Kamineni |
| 2008/0041811 | A1 | 2/2008 | Stowitts |
| 2010/0032405 | A1 | 2/2010 | Ozawa et al. |
| 2010/0116778 | A1 | 5/2010 | Melrose |
| 2011/0220668 | A1 | 9/2011 | Steih et al. |
| 2012/0175337 | A1 | 7/2012 | Gill |
| 2012/0216918 | A1* | 8/2012 | Tsuda ..... B65D 21/086 141/311 R |
| 2012/0261430 | A1 | 10/2012 | Boukobza |
| 2013/0153531 | A1 | 6/2013 | Schlies et al. |
| 2014/0048508 | A1 | 2/2014 | Kamineni et al. |
| 2014/0138343 | A1 | 5/2014 | Joshi et al. |
| 2014/0263162 | A1 | 9/2014 | Napoli et al. |
| 2014/0346135 | A1 | 11/2014 | Melrose |
| 2017/0073137 | A1 | 3/2017 | Maquita Nakano et al. |

FOREIGN PATENT DOCUMENTS

| | | | |
|---|---|---|---|
| JP | 2001-206331 | A | 7/2001 |
| JP | 2006240728 | A | 9/2006 |
| JP | 2009-007026 | A | 1/2009 |
| JP | 2012180122 | A | 9/2012 |
| RU | 2295479 | C2 | 3/2007 |
| WO | WO 2015/032962 | A1 | 3/2015 |

* cited by examiner

FIG. 16A
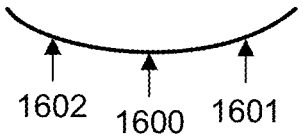
FIG. 16B
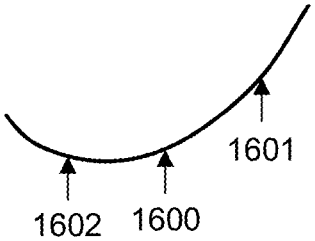
FIG. 16C
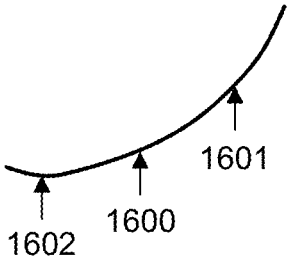
FIG. 16D
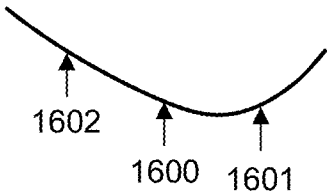
FIG. 16E
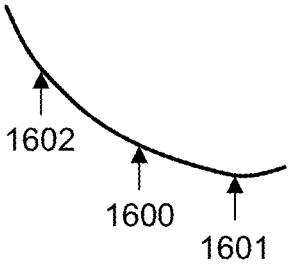
FIG. 16F

CONTAINER WITH PRESSURE ACCOMMODATION PANEL

CROSS-REFERENCE

This application is a continuation of U.S. patent application Ser. No. 15/019,806, filed Feb. 9, 2016, which is incorporated herein in its entirety by reference thereto.

BACKGROUND

Field

The present disclosure relates to containers.

BRIEF SUMMARY

In some embodiments, a container is provided. The container includes a first vacuum panel, a second vacuum panel, a third vacuum panel, a first diagonal column between the first vacuum panel and the second vacuum panel, and a second diagonal column between the second vacuum panel and the third vacuum panel. The second vacuum panel and the third vacuum panel are oriented in opposite directions. In response to a change in an internal container pressure, the container flexes at the first vacuum panel such that a surface of the first vacuum panel increases in concavity in response to an increasing pressure change.

In some embodiments, the increase in concavity comprises a first portion of the surface moving towards an interior of the container and a second portion of the surface moving towards the interior of the container by a different distance than the first portion.

In some embodiments, the first vacuum panel includes an upper surface and a lower surface, and concavities of the upper surface and the lower surface increase in response to the increasing pressure change. In some embodiments, the increase in the concavity of the upper surface is different than the increase in the concavity of the lower surface.

In some embodiments, a height of the first vacuum panel is at least one-third a total height of the container. In some embodiments, the second vacuum panel and third vacuum panel each includes a base, and a distance measured from the base of the second vacuum panel to the base of the third vacuum panel is at least one-third a total height of the container.

In some embodiments, a height of the second vacuum panel is at least one-fourth a total height of the container.

In some embodiments, the first vacuum panel has two sides that are angled with respect to a longitudinal axis of the container.

In some embodiments, the second vacuum panel and third vacuum panel each includes a base and two sides and the two sides of each vacuum panel form an acute angle.

In some embodiments, the second vacuum panel and third vacuum panel are triangular.

In some embodiments, in response to the change in the internal container pressure, the container flexes at the second vacuum panel and third vacuum panel such that the base of each panel increases in concavity in response to the increasing pressure change.

In some embodiments, the container has an initial volume, and the flexing of the container decreases the initial volume by 3%. In some embodiments, the flexing of the container decreases the initial volume by 5%.

In some embodiments, the container has an oval cross horizontal section at a position intersecting the first vacuum panel, the second vacuum panel, and the third vacuum panel.

In some embodiments, the first diagonal column and the second diagonal column intersect.

In some embodiments, a container is provided. The container includes a body portion. The body portion includes two diagonal pressure accommodation areas, two triangular areas, and at least one column between each diagonal pressure accommodation area and triangular area. Each diagonal pressure accommodation area includes a first surface, a second surface, and a third surface. The first surface, the second surface, and the third surface are vertically offset from each other. Each surface is configured to curve in towards an interior of the body in response to a change in pressure within the container.

In some embodiments, each of the diagonal pressure accommodation areas includes a grip region. In some embodiments, the grip regions include spaced-apart ribs.

In some embodiments, a container for storing a liquid filled in a hot state and then sealed is provided. The container includes a pressure accommodation panel. The pressure accommodation panel includes a top-right corner and a bottom-left corner. When the container is sealed, the pressure accommodation panel is configured to twist from an original shape such that the top right corner and the bottom left corner move towards an interior of the container. When the seal is released, the pressure accommodation panel is configured to return to its original shape.

In some embodiments, the twist is initiated by cooling of the liquid.

BRIEF DESCRIPTION OF THE DRAWINGS/FIGURES

Figure 13A:
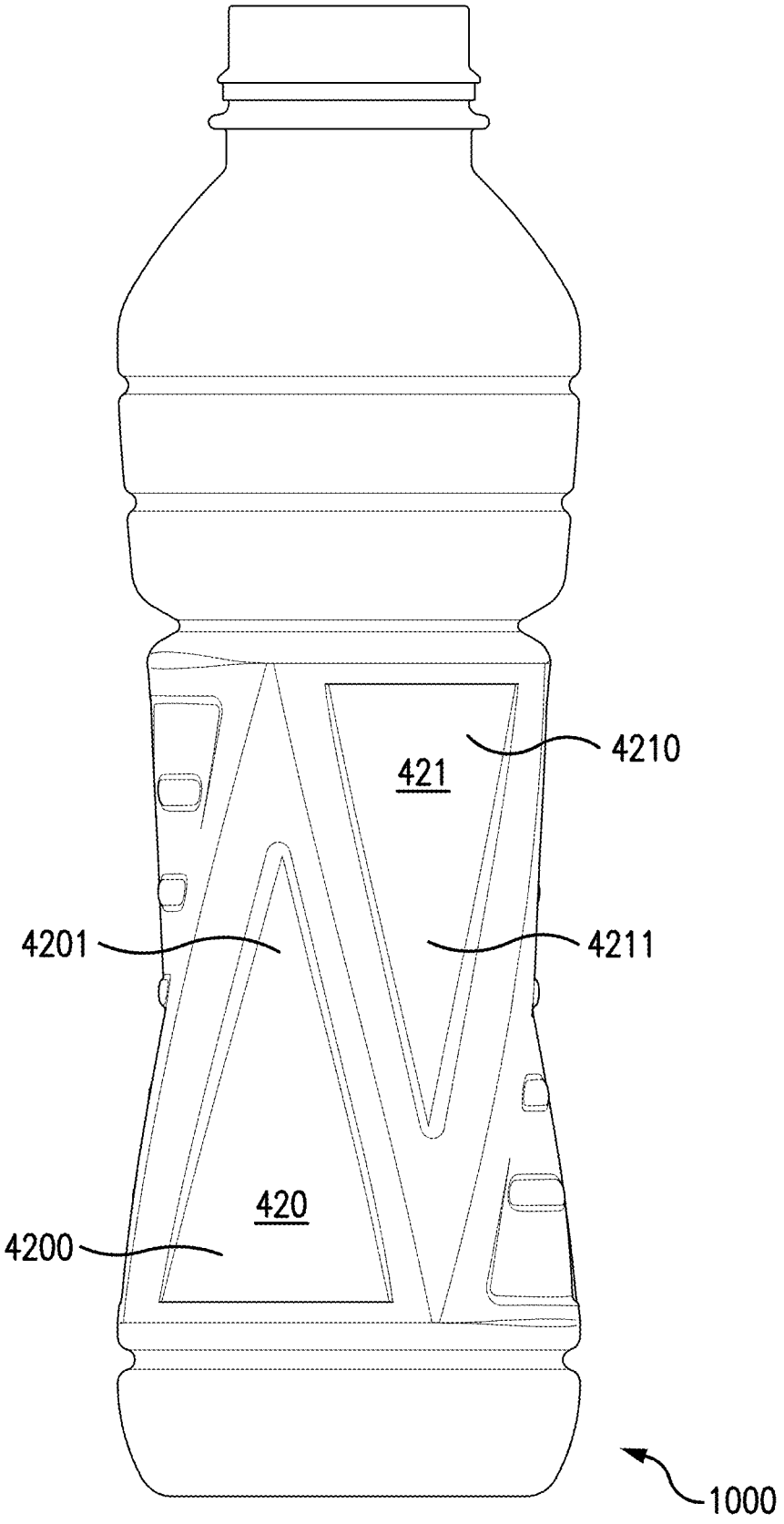
Figure 13B:
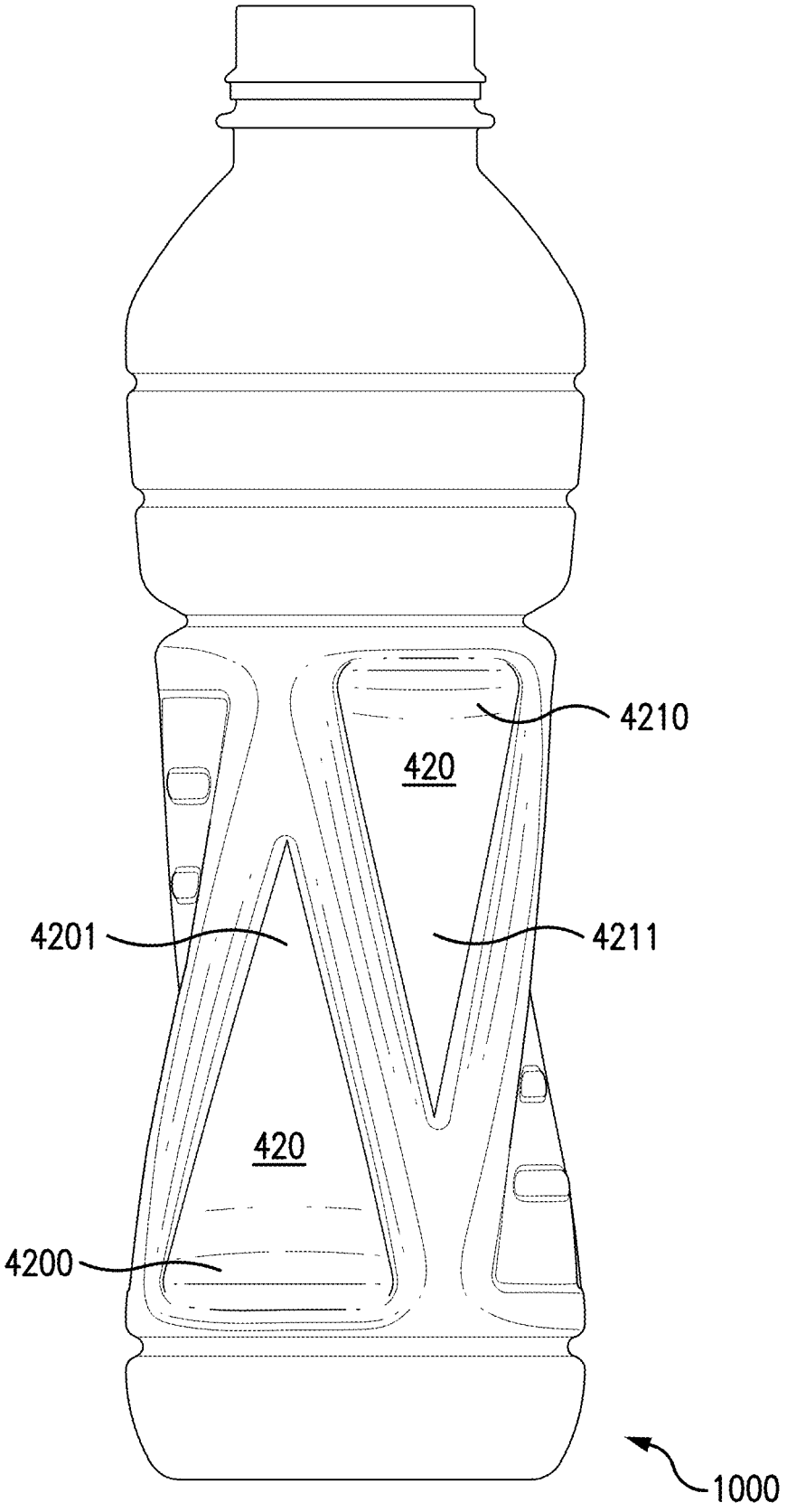
Figure 13C:
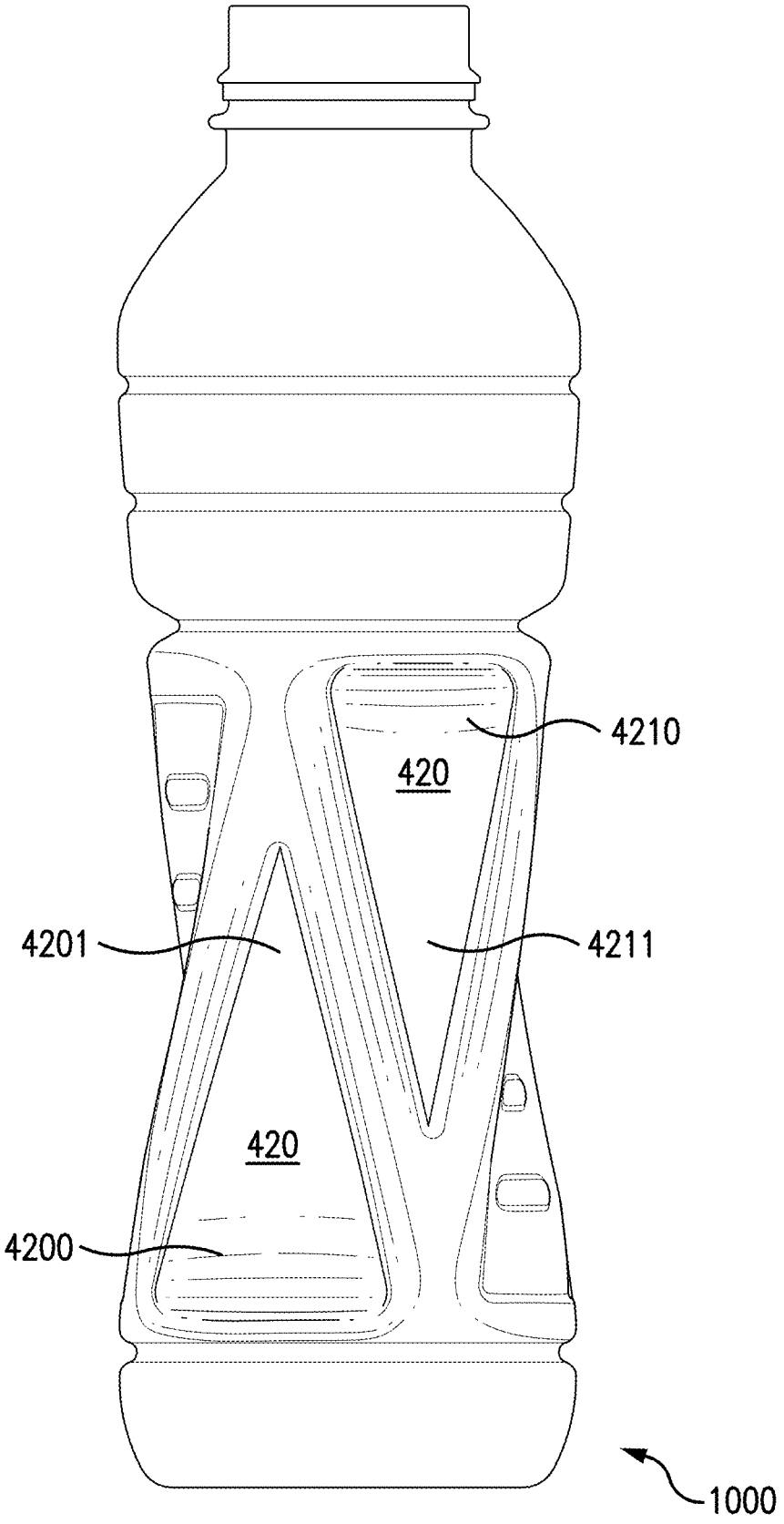

FIGS. 13A, 13B, and 13C illustrate changes in the shape of second and third vacuum panels during the flexing of the container according to some embodiments.

Figure 14A:
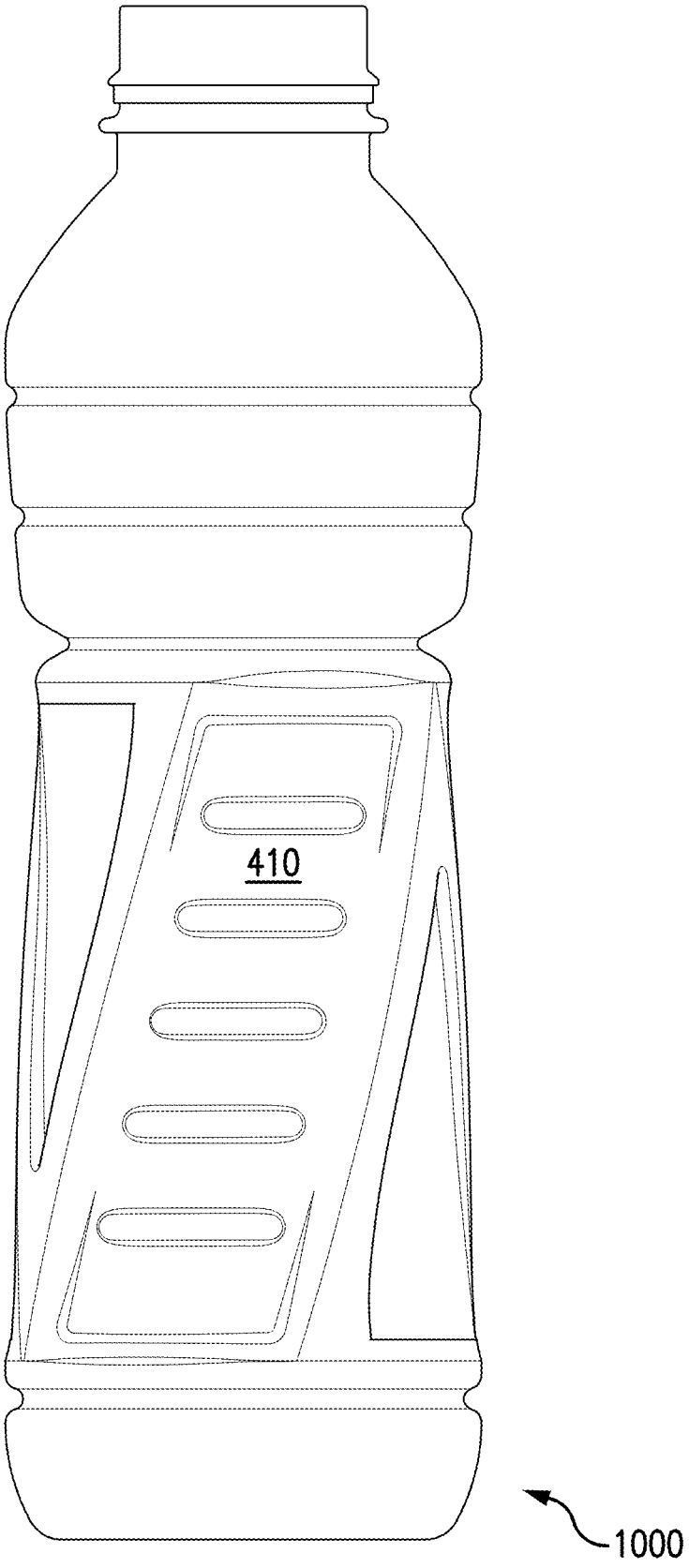
Figure 14B:
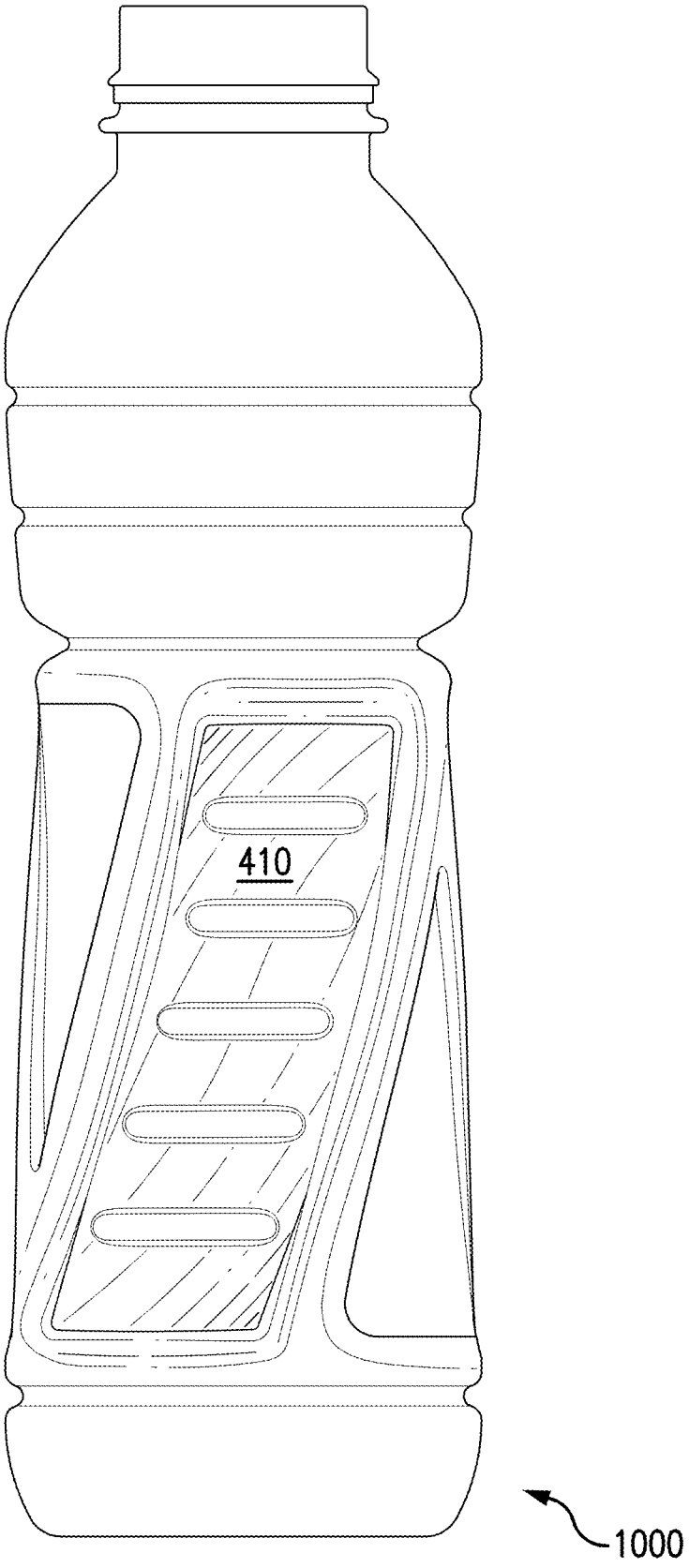
Figure 14C:
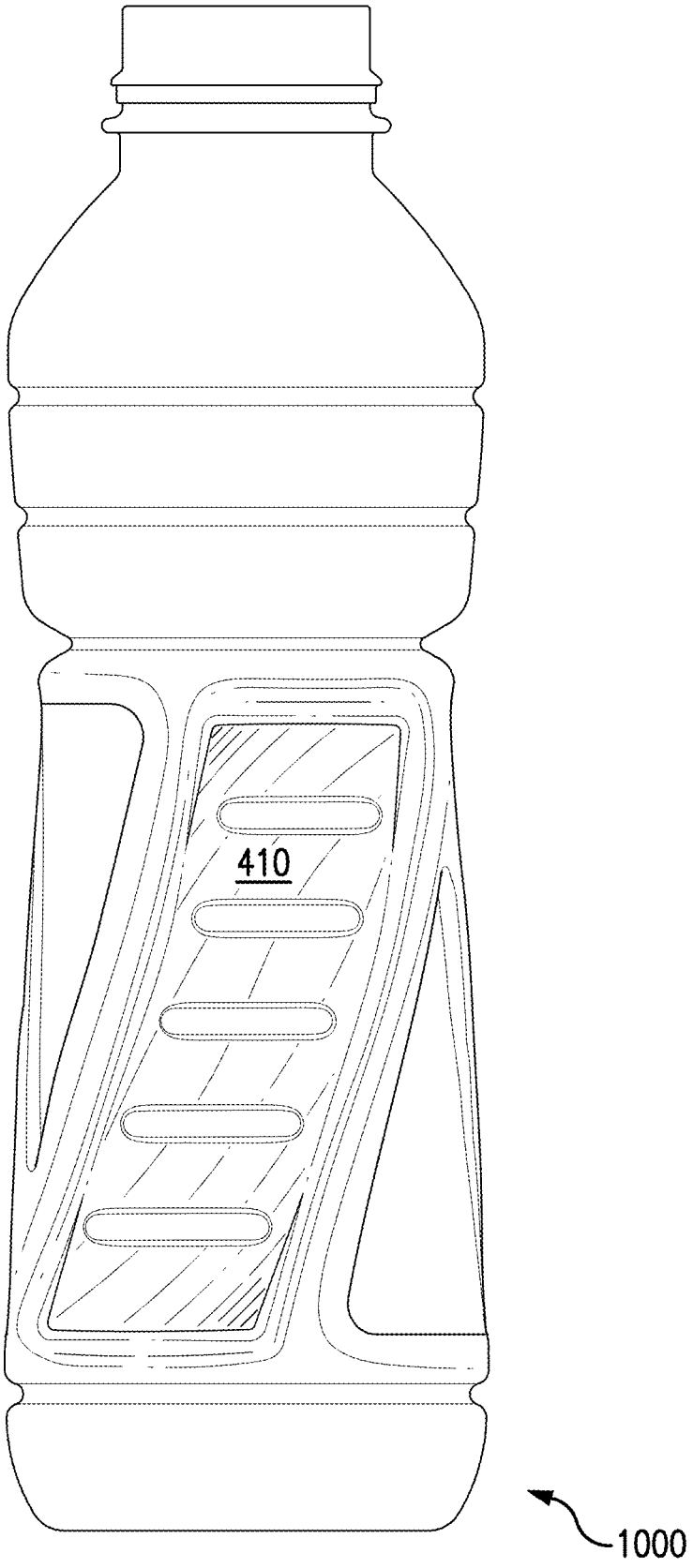

FIGS. 14A, 14B, and 14C illustrate changes in the shape of first vacuum panel during the flexing of the container according to some embodiments.

Figure 15A:
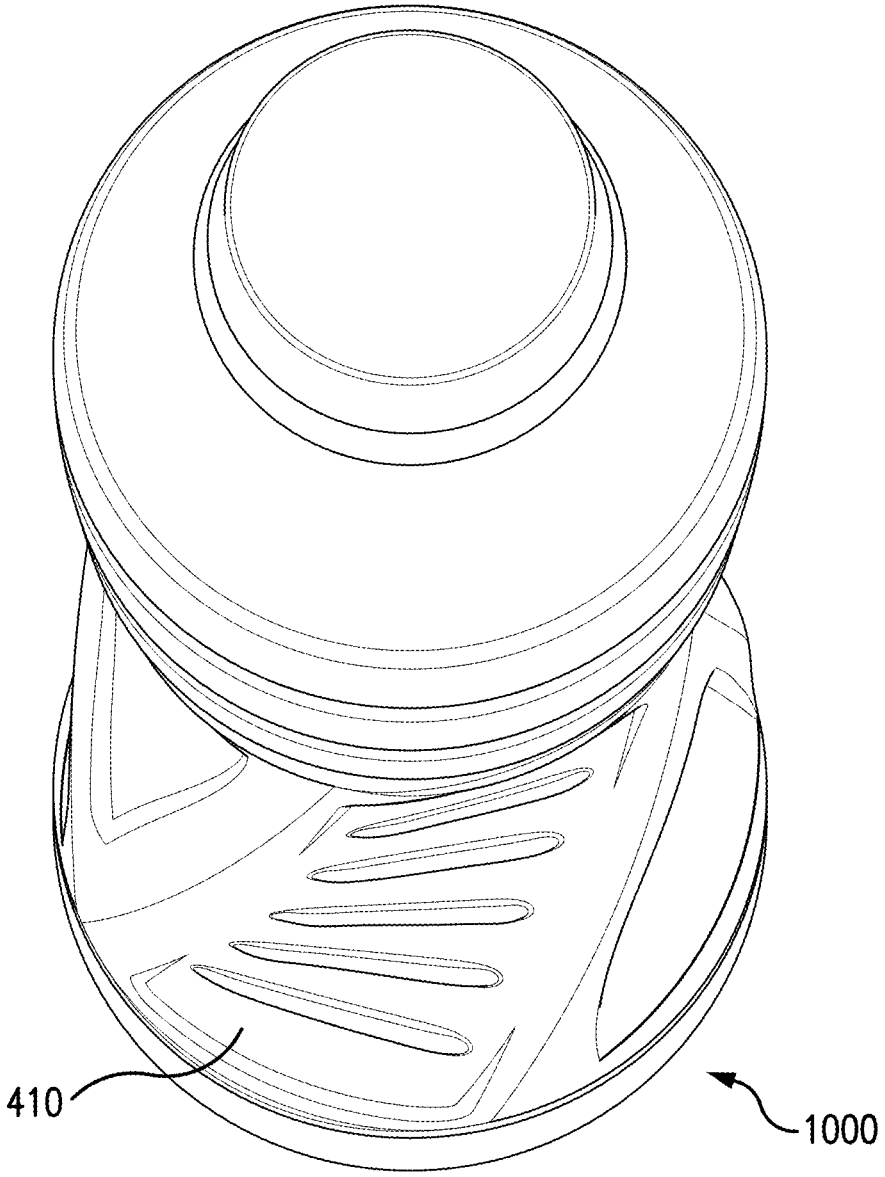
Figure 15B:
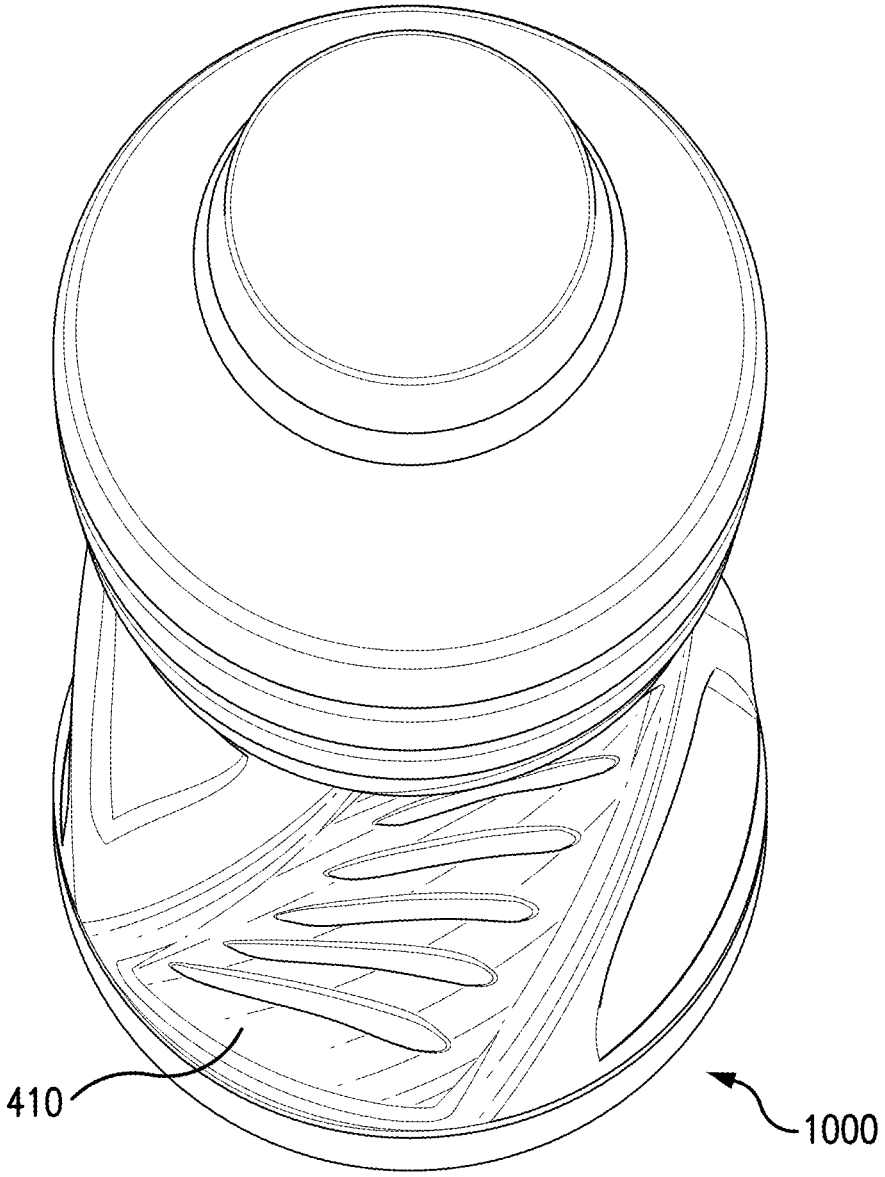

FIGS. 15A and 15B illustrate top perspective views of changes in the shape of the first vacuum panel during the flexing of the container according to some embodiments.

FIGS. 16A, 16B, 16C, 16D, 16E, 16E, and 16F show representations of the change in concavity of the first vacuum panel according to some embodiments.

DETAILED DESCRIPTION

Drinkable fluids provided to consumers, such as juices, soft drinks, and sports drinks, may be bottled using a hot-fill process. With this process, the liquid is heated to an elevated temperature and then bottled while at that elevated temperature. Specific heating temperatures vary depending on the liquid being bottled and the type of container being used for bottling. For example, when bottling a liquid for a sports drink using a container made of PET, the liquid may be heated to a temperature of 83° C. or higher. The elevated liquid temperature sterilizes the container upon filling such that other sterilization processes are not needed. After the liquid is filled, the container is immediately capped, sealing the hot liquid inside the container. The container, along with the liquid inside, is then actively cooled before the container is labeled, packaged, and shipped to the consumer.

Despite the benefits of the hot-fill process, the cooling down of the liquid after filling may cause deformation of the container and stability issues. For example, a liquid that is heated to 83° C. may be cooled down to 24° C. for the labeling, packaging, and shipping process. The cooling of the hot liquid reduces the volume of the liquid inside the container. Because the container is sealed, the volume reduction of the liquid results in a change in the container's internal pressure such that the pressure inside the container becomes lower than the pressure surrounding the container. For example, the pressure inside the container may change such that it is 1-550 mm Hg less than the pressure surrounding the container (atmospheric pressure).

As the internal pressure in the container drops, it creates a pressure differential (vacuum) that causes stresses to the container. If left uncontrolled, these stresses may result in undesirable distortion of the container shape as the container and contents tend toward an equilibrium state. For example, the container may distort significantly from its original shape so that it is difficult to label or package the container. The distortion may also negatively impact aesthetics of the container.

Thus, there exists a need for a container that may accommodate this internal pressure change during the bottling process so the container does not drastically deform from its original shape. Additionally, the container should be able to accommodate this change in internal pressure in a way that does not interfere with the stability and usability of the container. For example, the container, in its deformed shape, should still be able to withstand forces that may be experienced during shipment. Additionally, the accommodation method should not interfere with a consumer's use of the container, such as when the consumer dispenses the liquid from the container. Also, the accommodation method may be configured such that the distortion contributes to the aesthetics of the container.

In some embodiments described herein, containers include a first vacuum panel, a second vacuum panel, and a third vacuum panel where the second vacuum panel and the third vacuum panel are oriented in opposite directions. A first diagonal column is located between the first vacuum panel and the second vacuum panel. A second diagonal column is located between the second vacuum panel and the third vacuum panel. Due to the shape of the panels and orientation of the panels and columns, the container may safely accommodate a change in the internal pressure of the container without causing uncontrollable distortion. In some embodiments, the panels and orientation of the panels and columns allow the container to twist or exhibit different radial movement along its height as it deforms. Additionally, the vacuum panels disclosed herein do not interfere with the container's usability. In some embodiments, the vacuum panels contribute to the usability of the container.

Figure 1:
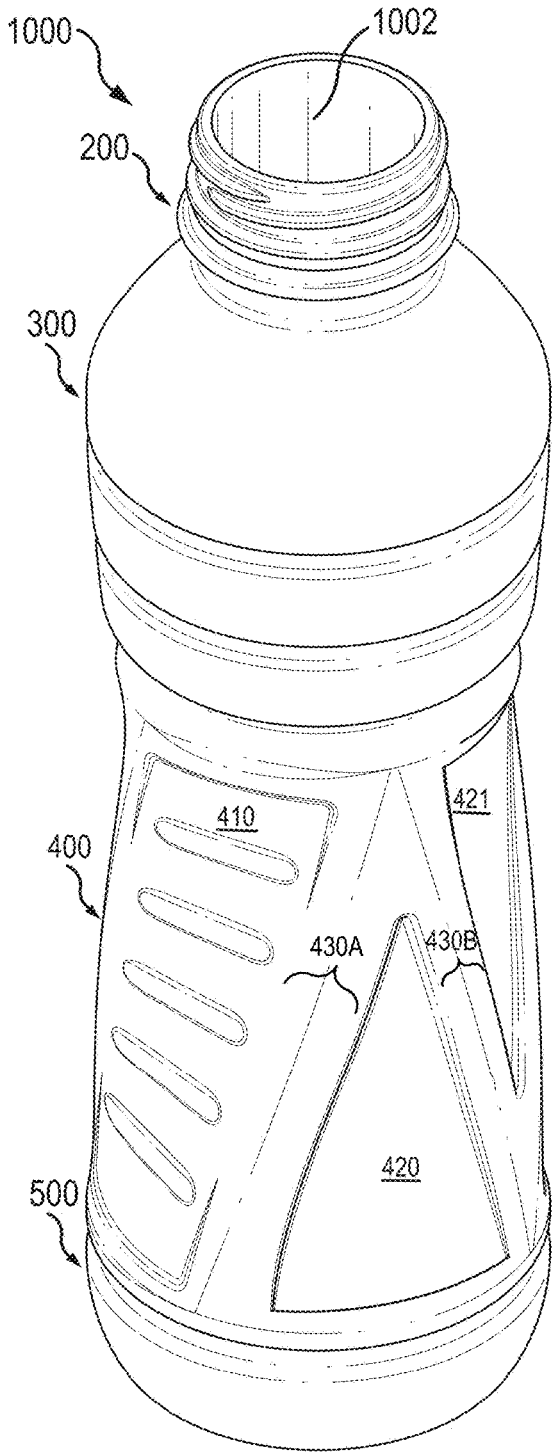
FIG. 1 is a top perspective view of a container according to some embodiments.
Figure 2:
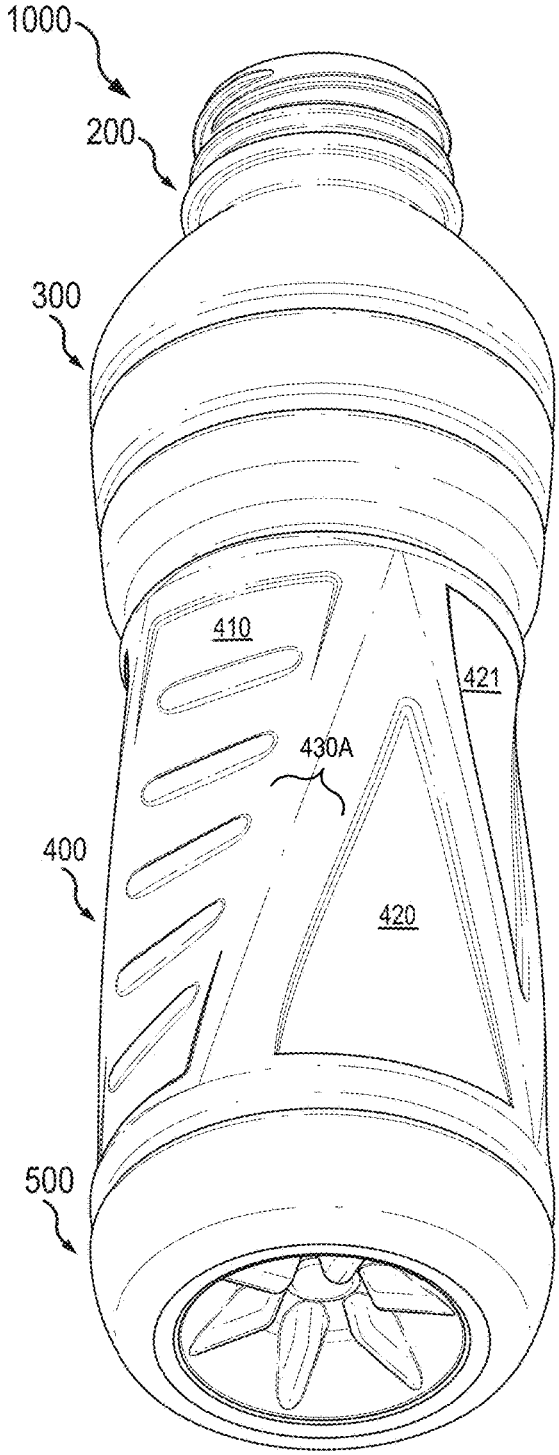
FIG. 2 is a bottom perspective view of a container according to some embodiments.
Figure 3:
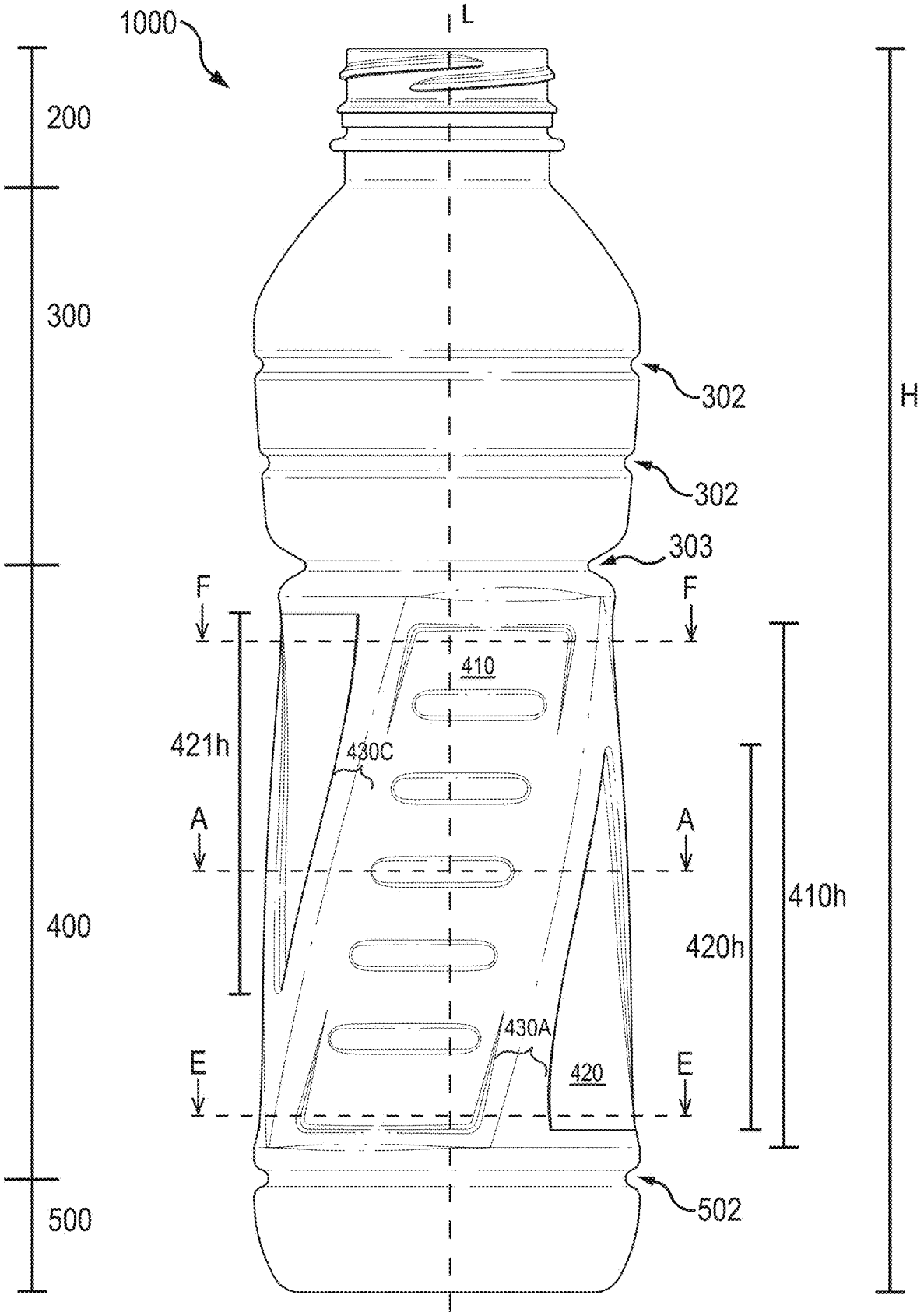
FIG. 3 is front view of a container according to some embodiments.
Figure 5:
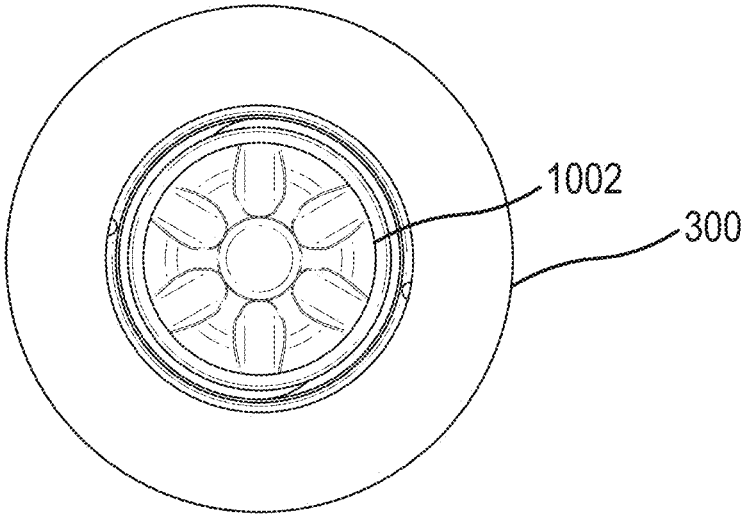
FIG. 5 is a top view of a container according to some embodiments.
Figure 6:
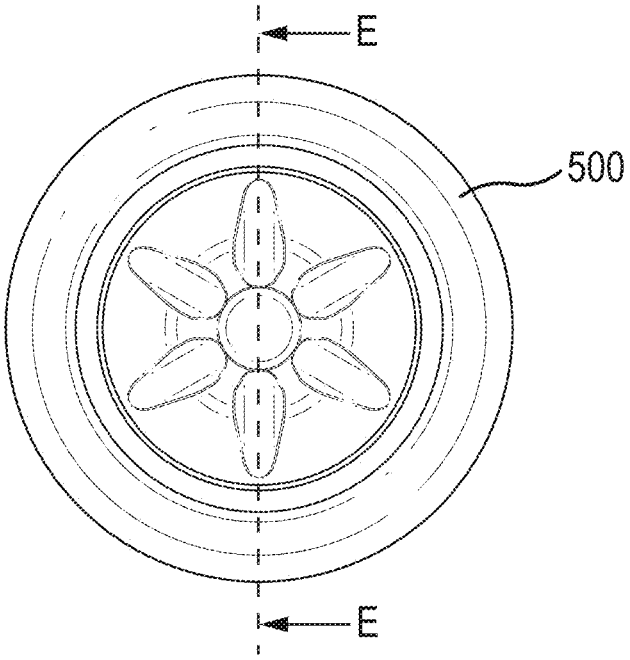
FIG. 6 is a bottom view of a container according to some embodiments.
Figure 9A:
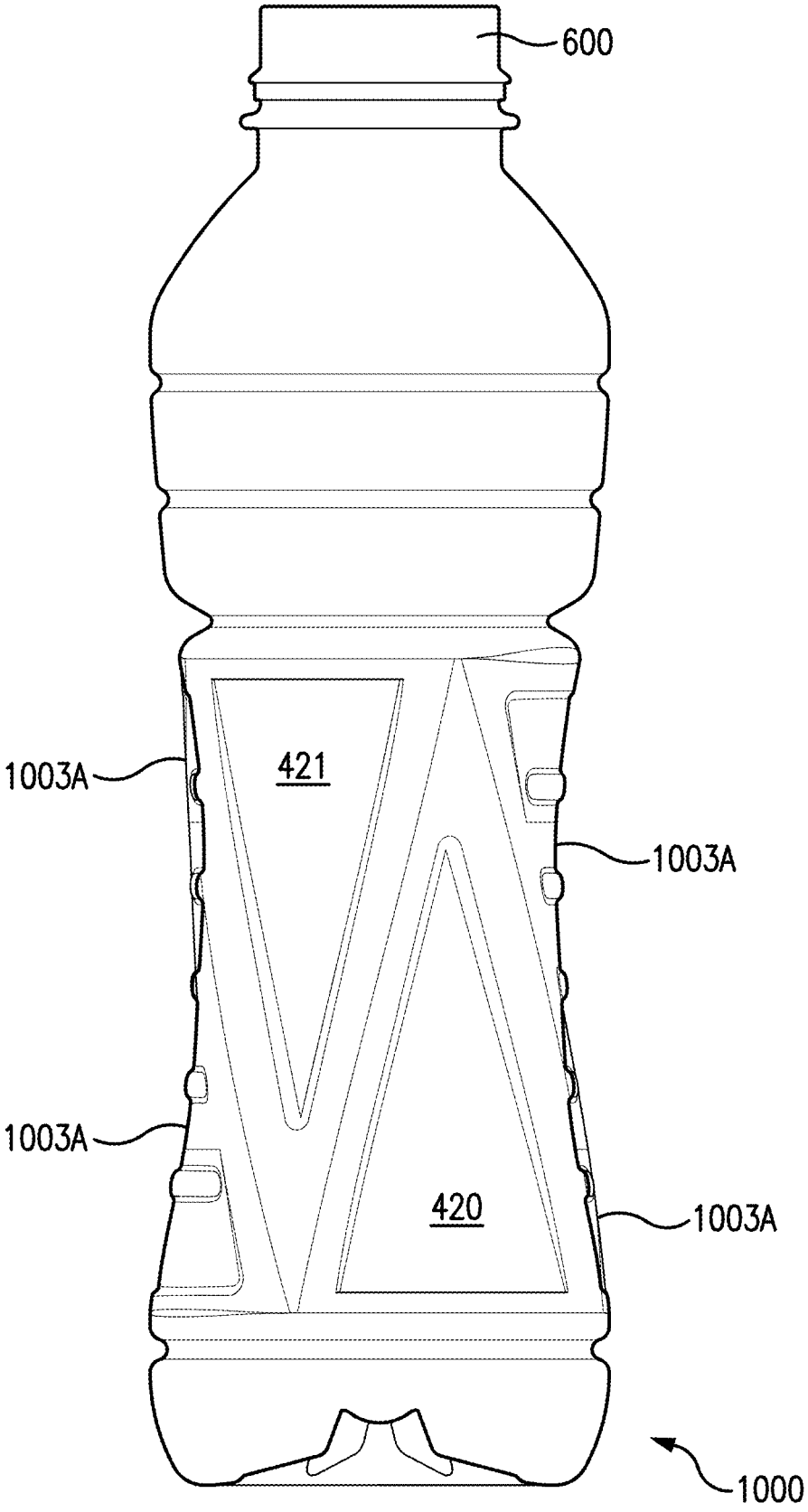
FIG. 9A is a cross-sectional view of the container of FIG. 3 at longitudinal axis L at point A of the graph in FIG. 8 according to some embodiments.

In some embodiments, and as shown in FIGS. 1-3, a container 1000 has a neck portion 200, a shoulder portion 300, a body portion 400, and a base portion 500. A container opening 1002 allows for liquid to flow in and out of container 1000. FIG. 5 shows a top view of container 1000 with opening 1002 visible. Container 1000 may also include a lid 600, (e.g., as shown in FIG. 9A), which is placed over the neck portion 200 after the container is filled to seal the container from the outside environment. Lid 600 may be removed from the neck portion 200 in order to access the liquid. FIG. 6 shows a bottom view of container 1000 with base portion 500.

Figure 7A:
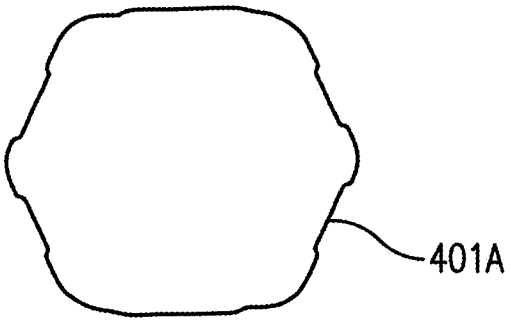
FIG. 7A is a view showing the outline of the container of FIG. 3 at line A-A.
Figure 7B:
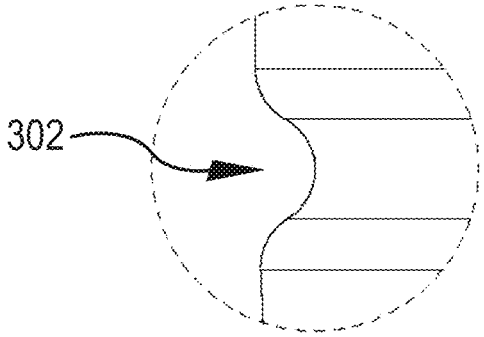
FIG. 7B is a close-up view of area B in the container of FIG. 4.
Figure 7C:
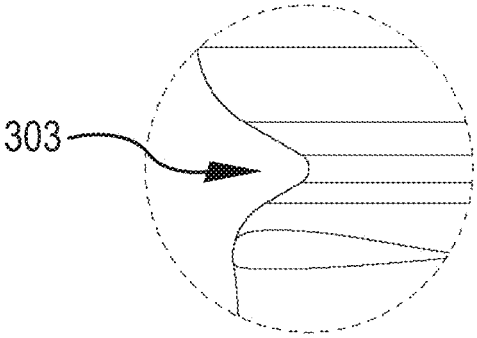
FIG. 7C is a close-up view of area C in the container of FIG. 4.

FIG. 7C shows an up-close view of the transition between the shoulder portion 300 and the body portion 400. In some embodiments, and as shown in FIG. 7C, the transition includes a deep recess 303. Deep recess 303 may help to isolate the deformation of container 1000 to body portion 400. In some embodiments, shoulder portion 300 is greater in circumference than body portion 400 (e.g., a horizontal cross-section of shoulder portion 300 encloses a greater area than does a horizontal cross-section of body portion 400).

Figure 7D:
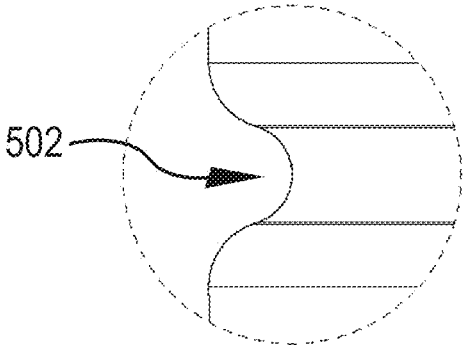
FIG. 7D is a close-up view of area D in the container of FIG. 4.
Figure 7E:
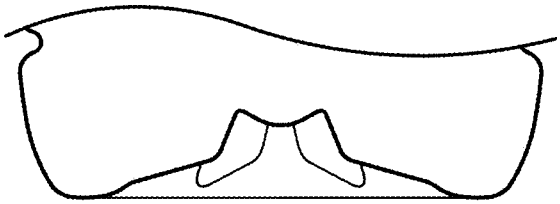
FIG. 7E is a partial view showing the outline of the container of FIG. 6 at line E-E.

FIG. 7D shows an up-close view of the transition between base portion 500 and body portion 400. In some embodiments, and as shown in FIG. 7D, the transition includes a recess 502. Like deep recess 303, recess 502 may also help to isolate the deformation of container 1000 to body portion 400.

Container 1000 may be any vessel that is suitable for storing a liquid, in which, during storage, the internal pressure of container 1000 changes. In some embodiments, container 1000 is a bottle. In some embodiments, container 1000 is made of PET (polyethylene terephthalate), but other suitable flexible and resilient materials may be used, including, but not limited to, plastics such as PEN (polyethylene naphthalate), bioplastics such as PEF (polyethylene furanoate), and other polyesters.

As shown in FIG. 3, container 1000 has a height H that is measured from the beginning of the neck portion 200 to the end of the base portion 500. Sections 302 of shoulder portion 300 are ridged, with the ridges extending around the entire circumference of those sections. FIG. 7B shows a close-up view of a ridged section 302.

Referring now to FIG. 1 and FIG. 2, body portion 400 of container 1000 includes a first vacuum panel 410, a second vacuum panel 420, and a third vacuum panel 421. FIG. 7A shows a view of an outline of container 1000 across line A-A of FIG. 3. These vacuum panels control the deformation of container 1000 during the hot-fill process such that the container maintains its stability and deforms in a controllable and predictable manner.

FIGS. 1 and 2 show first vacuum panel 410, second vacuum panel 420, and third vacuum panel 421 arranged such that first vacuum panel 410, second vacuum panel 420, and third vacuum panel 421 are located at different locations along the circumference of container 1000.

Figure 4:
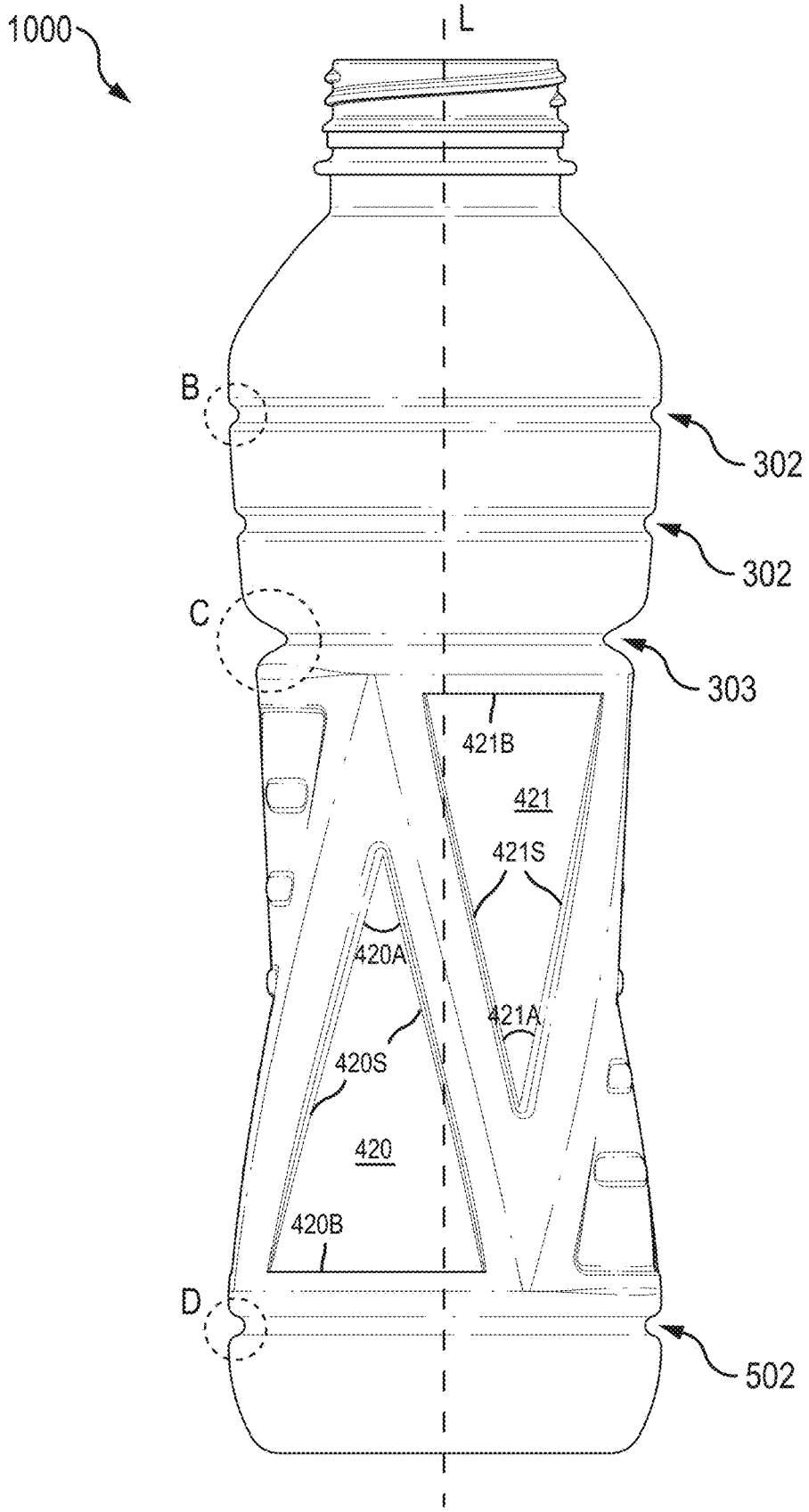
FIG. 4 is a right side view of a container according to some embodiments.

As shown in FIG. 4, second vacuum panel 420 has base 420B and at least two sides 420S extending from base 420B that are angled with respect to a longitudinal axis L of container 1000. Third vacuum panel 421B has base 421B and at least two sides 421S extending from base 421B that are angled with respect to a longitudinal axis L of container 1000. In some embodiments, and as shown in the figures, sides 420S meet at a point to form an acute angle 420A. In some embodiments, and as shown in the figures, sides 421S meet at a point to form an acute angle 421A. In some embodiments, second vacuum panel 420 and third vacuum panel 421 have a triangular shape.

In some embodiments, second vacuum panel 420 is similar to third vacuum panel 421 in every way except that second vacuum panel 420 and third vacuum panel 421 are oriented in different directions. This means that second vacuum panel 420 and third vacuum panel 421 are shaped and located such that they are not similarly oriented on container 1000 (e.g., second vacuum panel 420 may be oriented 180 degrees differently with respect to third vacuum panel 421). For example, when second vacuum panel 420 and third vacuum panel 421 are triangular, second vacuum panel 420 and third vacuum panel 421 may be oriented in opposite or opposing directions such that second vacuum panel 420 points "up" towards neck portion 200 and third vacuum panel 421 points "down" towards base portion 500. This is shown in FIG. 4.

In some embodiments and as shown in FIG. 3, which shows a front of container 1000, first vacuum panel 410 is angled with respect to longitudinal axis L of container 1000. In some embodiments, and as shown in FIGS. 1, 2, and 3, first vacuum panel 410 is angled such that it is slanted to the right side of container 1000. In such embodiments, base 420B of second vacuum panel 420 may be closer in distance to base portion 500 than base 421B and angle 420A may be closer in distance to shoulder portion 300 than angle 421A.

In some embodiments, first vacuum panel 410 is angled such that it is slanted to left side of container 1000. In these embodiments, second vacuum panel 420 and third vacuum panel 421 are also oriented opposite of each other, but their orientations may be flipped. For example, base 420B of second vacuum panel 420 may be closer in distance to shoulder portion 300 than base 421B and angle 420A may be closer in distance to base portion 500 than angle 421A. In other words, second vacuum panel 420 may point "down" towards base portion 500 and third vacuum panel 421 may point "up" towards neck portion 200.

In some embodiments, container 100 includes two first vacuum panels 410, two second vacuum panels 420, and two third vacuum panels 421, arranged as described above such that one of the first vacuum panels 410 is angled such that it is slanted to the right side of container 1000 and the other of the first vacuum panels 410 is angled such that it is slanted to the left side of container 1000. In such a configuration, both first vacuum panels 410 may be radially slanted in the same direction (e.g., clockwise or counterclockwise around the periphery of container 1000).

In some embodiments, and as shown in FIG. 3, first vacuum panel 410 has a height 410*h* that is taller than both a height 420*h* of second vacuum panel 420 and a height 421*h* of third vacuum panel 421. However, in some embodiments, all heights 410*h*, 420*h*, and 421*h* may be equal. Other height relationships are also envisioned, so long as the vertical distance from base 420B to base 421B is similar to height 410*h*.

In some embodiments, height 410*h* is at least one-third the total height H of container 1000. In some embodiments height 410*h* is at least one-half the total height H of container 1000. In some embodiments, height 420*h* and height 421*h*, individually, are at least one-fourth the total height H of container 1000. In some embodiments, height 420*h* and height 421*h*, individually, are at least one-third the total height H of container 1000. Thus, in some embodiments, first vacuum panel 410, second vacuum panel 420, and third vacuum panel 421 are prominent features of container 1000 and account for a substantial portion of the surface area of container 1000 (e.g., greater than 15% or greater than 20%).

Body portion 400 of container 1000 may also include a first column 430A and a second column 430B. As shown in FIGS. 1 and 2, first column 430A may be located between first vacuum panel 410 and second vacuum panel 420 and second column 430B may be located between second vacuum panel 420 and third vacuum panel 421. In some embodiments, columns 430A and 430B may extend radially out further than vacuum panels 410, 420, and 421 such that at least portions of vacuum panels 410, 420, and 421 are recessed with respect to columns 430A and 430B from a perspective exterior to container 1000. In some embodiments, first column 430A is circumferentially adjacent to first vacuum panel 410 and second vacuum panel 420. In some embodiments, second column 430B is circumferentially adjacent to second vacuum panel 420 and third vacuum panel 421. First column 430A and second column 430B contribute to the stability of the container during flexing. In some embodiments, and as shown in the Figures, first column 430A and second column 430B are angled with respect to a longitudinal axis L (shown in FIG. 4) of container 1000 and meet or intersect near angle 420A.

As will be described in further detail below, this arrangement initiates and contributes to the flexing of the container 1000. However, other arrangements are also envisioned so long as the flexing of first vacuum panel 410, second vacuum panel 420, and the third vacuum panel 421 described herein may be achieved.

Container 1000 may have more than one first vacuum panel 410, more than one second vacuum panel 420, and more than one third vacuum panel 421. As shown in the figures, in some embodiments container 1000 may have two first vacuum panels 410, two second vacuum panels 420, and two third vacuum panels 421.

In embodiments with two first vacuum panels 410, two second vacuum panels 420, and two third vacuum panels 421, the six panels may be located in container 1000 circumferentially. For example, in some embodiments, the two first vacuum panels 410 are positioned diametrically opposite each other, the two second vacuum panels 420 are positioned diametrically opposite each other, and the two third vacuum panels 421 are positioned diametrically opposite each other. This is shown, for example, in FIG. 12A. The diametric opposition of similar panels provides container 1000 with symmetrical deflection sites and may help to ensure that container 1000 deforms in a uniform and aesthetically pleasing manner. Additionally, in embodiments with six panels, a third diagonal column 430C is located between first vacuum panel 410 and third vacuum panel 421, as shown in FIG. 3. Third column 430C, like first column 430A and second column 430B, also contributes to stability of the container during flexing. Additionally, in some embodiments, third column 430C may be substantially parallel to first column 430A.

As described in more detail elsewhere herein, this arrangement also allows container 1000 and, more specifically, the horizontal cross-section of container 1000 at line A-A in FIG. 3, to retain its generally oval shape throughout deformation due to the similar way the diametrically opposed vacuum panels change in response to the change in internal pressure.

In some embodiments container 1000 may include more than two first vacuum panels 410, more than two second vacuum panels 420, and more than two third vacuum panels 421. A person of ordinary skill in the art, with the benefit of this disclosure, could determine an appropriate number of vacuum panels 410, 420, and 421 and suitable placement of each depending on bottle shape and design.

Figure 12A:
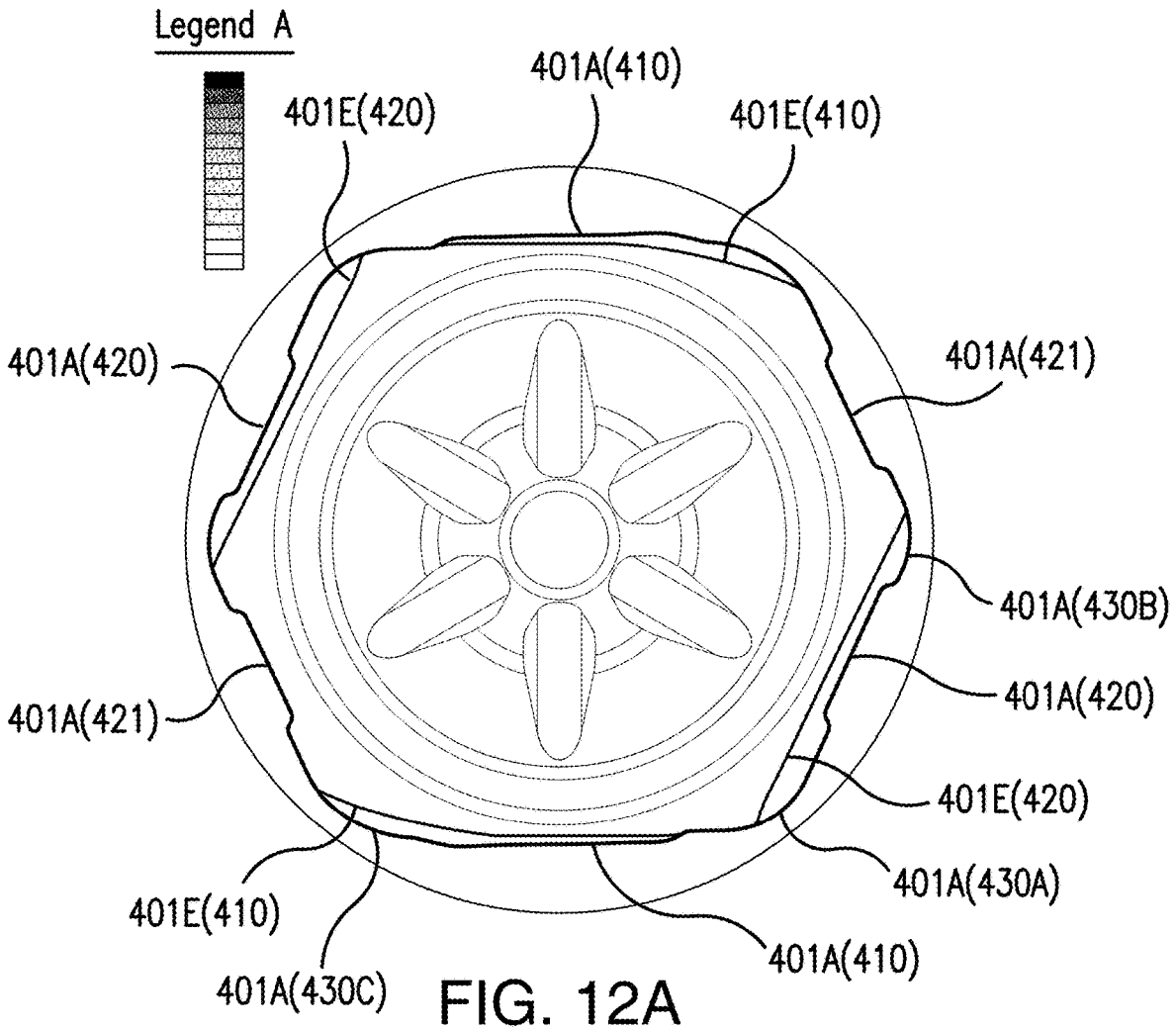
FIG. 12A is a cross-sectional view of the container of FIG. 3 at line A-A at point A of the graph in FIG. 8 according to some embodiments.
Figure 12B:
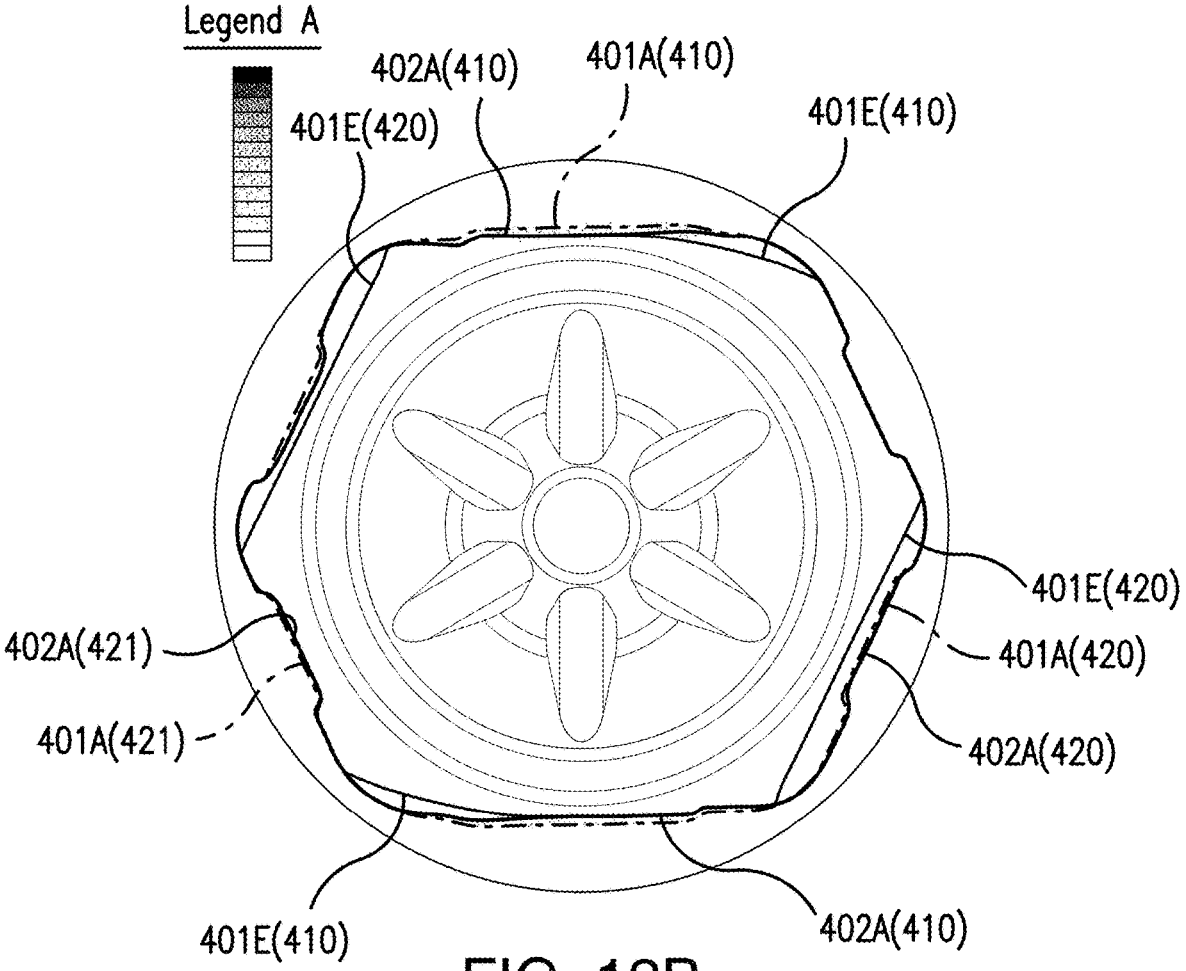
FIG. 12B is a cross-sectional view of the container of FIG. 12A at point B of FIG. 8 according to some embodiments.
Figure 12C:
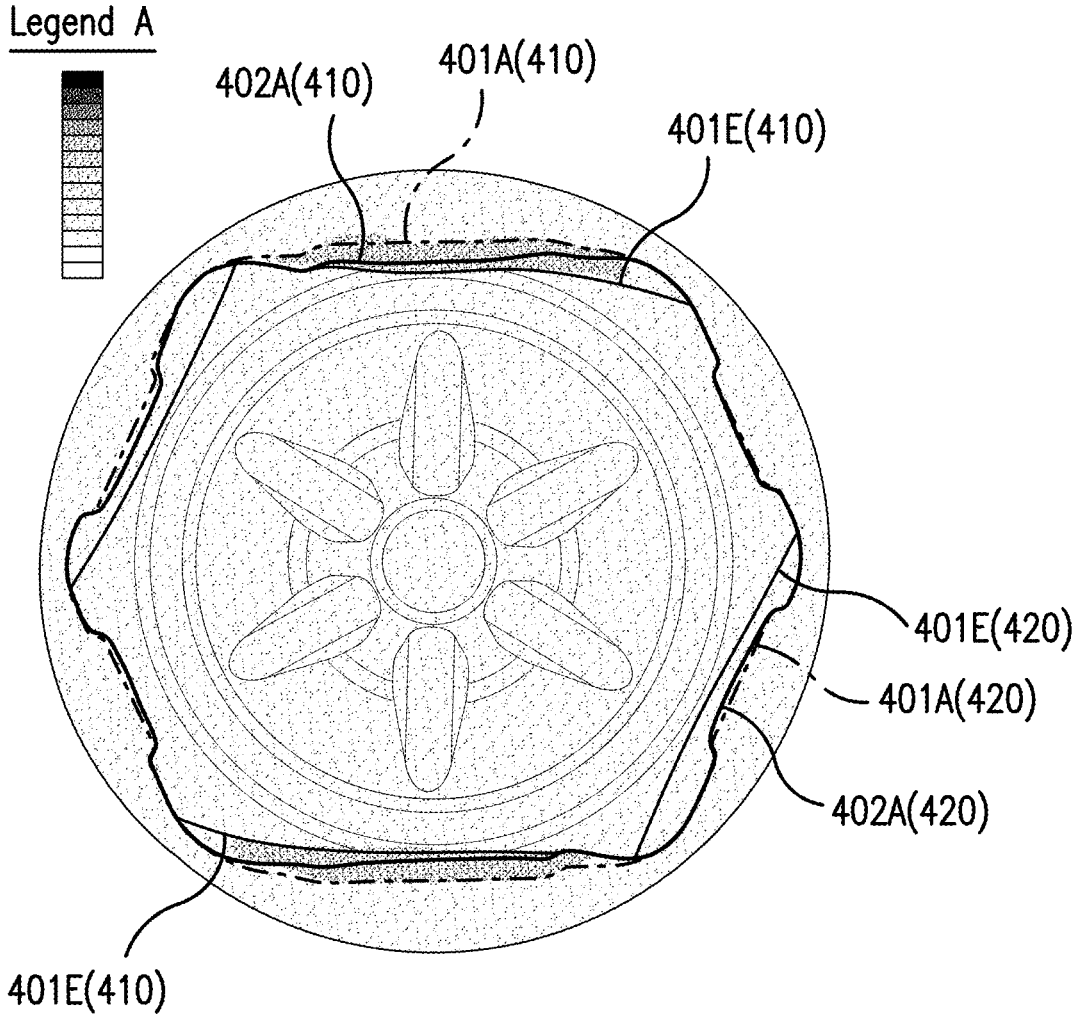
FIG. 12C is a cross-sectional view of the container of FIG. 12A at point C of FIG. 8 according to some embodiments.
Figure 12D:
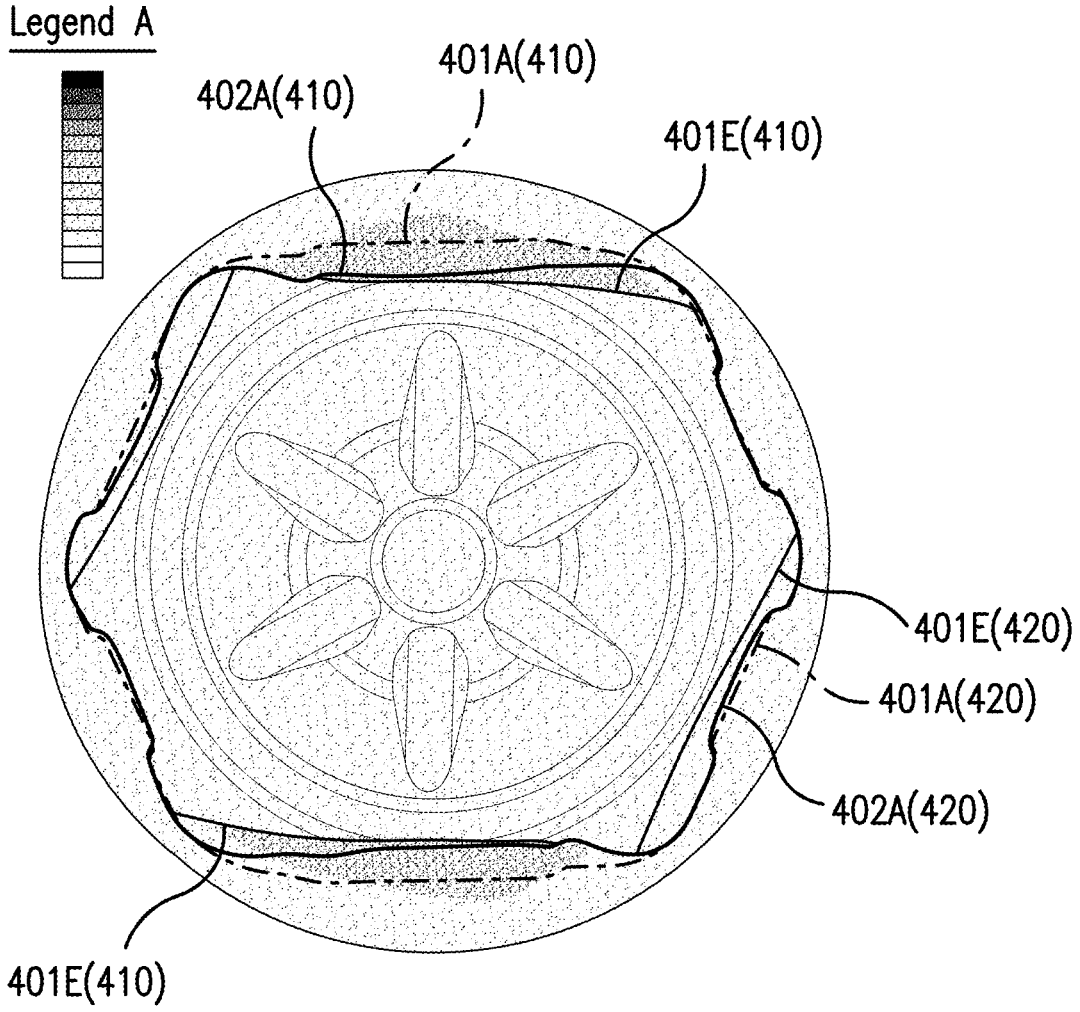
FIG. 12D is a cross-sectional view of the container of FIG. 12A at point D of FIG. 8 according to some embodiments.
Figure 12E:
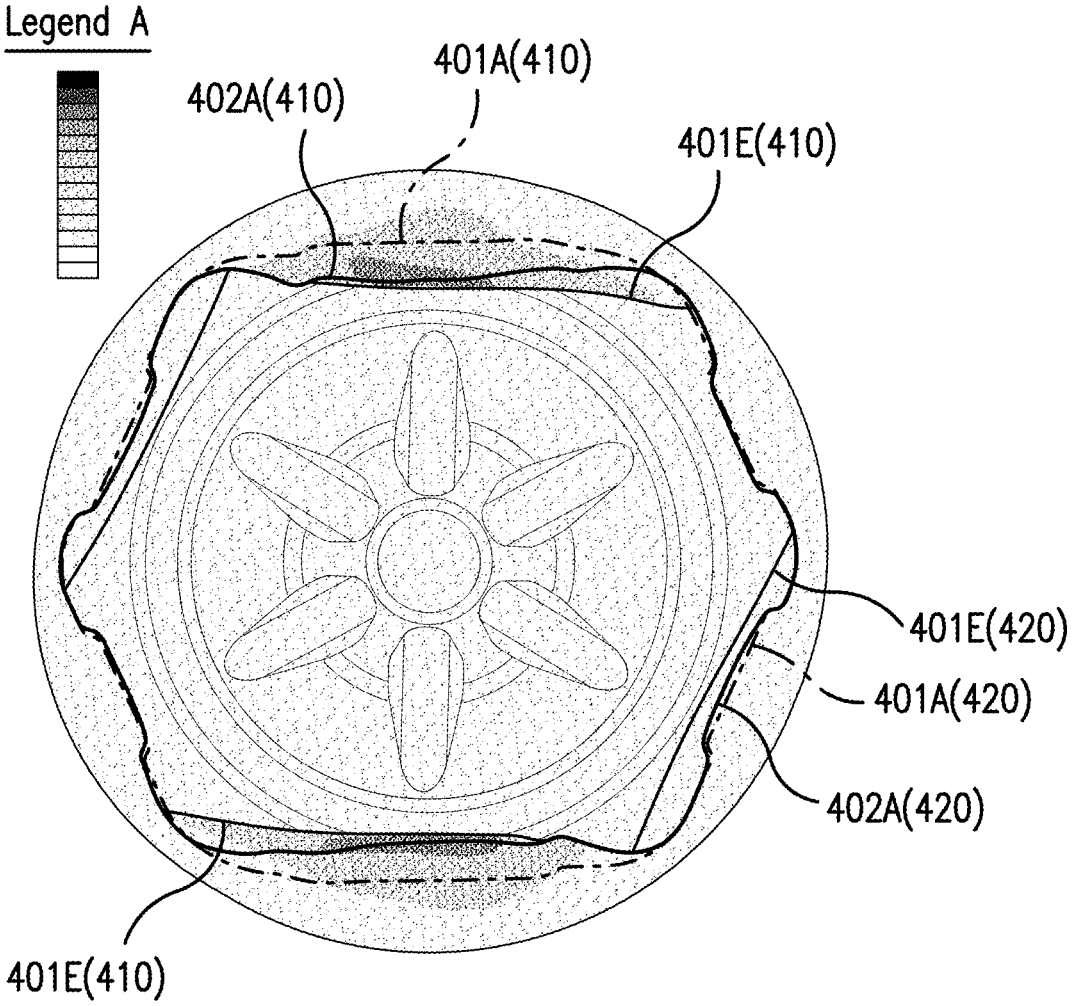
FIG. 12E is a cross-sectional view of the container of FIG. 12A at point E of FIG. 8 according to some embodiments.
Figure 12F:
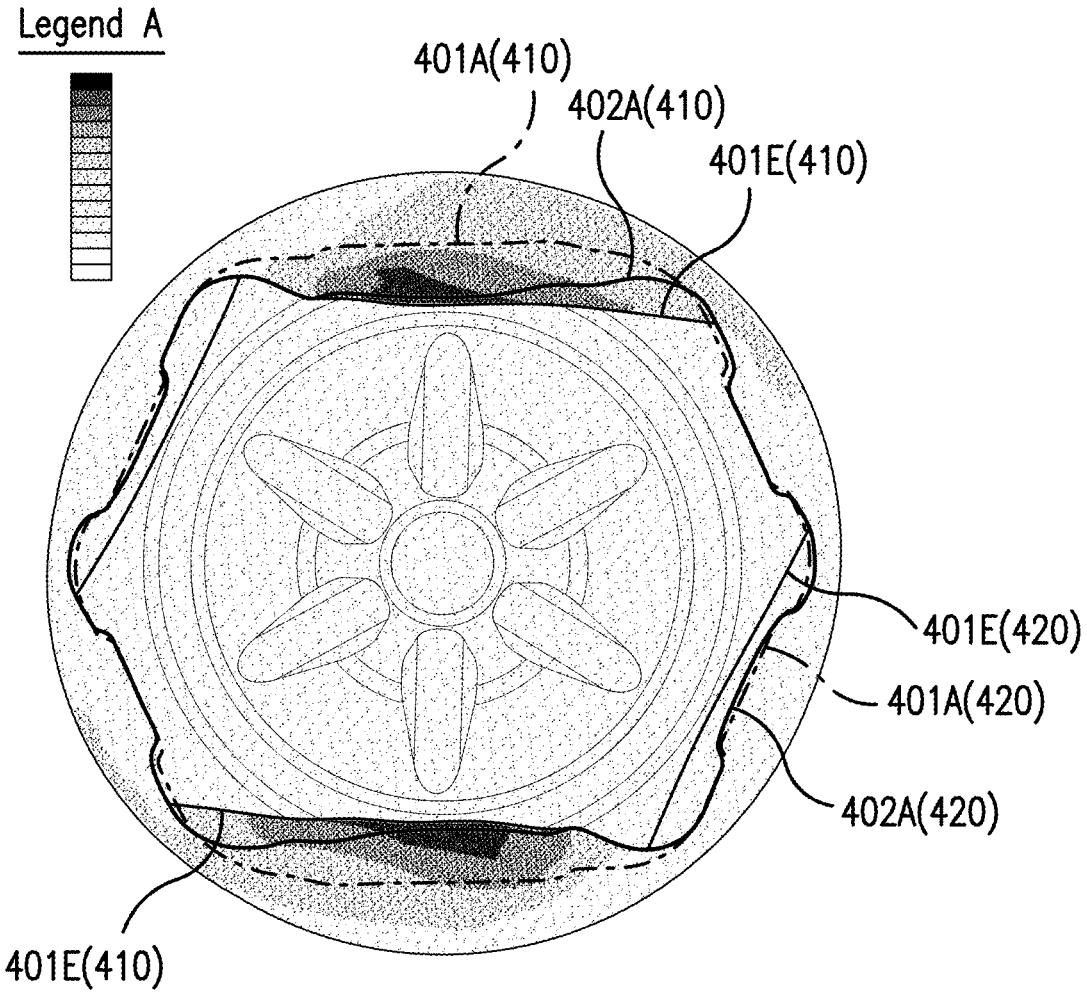
FIG. 12F is across-sectional view of the container of FIG. 12A at point F of FIG. 8.

In some embodiments, and as can be seen in FIGS. 7A and 12A, body portion 400 has a generally oval circumference at line A-A in FIG. 3. As used herein, "oval" includes a shape with two different perpendicular diameters that act as axes of symmetry, not accounting for minor variation due to surface detail. Thus, for a shape to be considered oval, exact symmetry along the two different perpendicular diameters is not needed. For example, the shape defined by line 401A in FIG. 12A may be considered as being generally oval in shape, although the two diametrically opposing 401A (410) portions are not necessarily mirror images of each other. In some embodiments, container 1000 retains a generally oval shape at line A-A through its deformation, even though the original oval shape may not be retained. This may be seen in FIGS. 12A-12G, with a comparison between 401A, showing the original oval shape of the circumference and 402A, showing the deformed oval shape of the circumference. In some embodiments, and as seen in FIGS. 12A-12G, the oval shape after deformation is more substantial than the original oval shape (i.e., the two perpendicular diameters of the oval shape after deformation are more different than in the original oval shape).

Ways in which vacuum panels 410, 420, and 421 control deformation of container 1000 will now be discussed in reference to FIG. 8, FIGS. 9A-9G, 10A-10G, 11A-11G, 12A-12G, 13A-13C, 14A-14C, and 15A-15B.

After container 1000 is filled with hot liquid, lid 600 is placed over the neck portion 200, sealing the container from the environment. This is shown in FIG. 9A.

Figure 8:
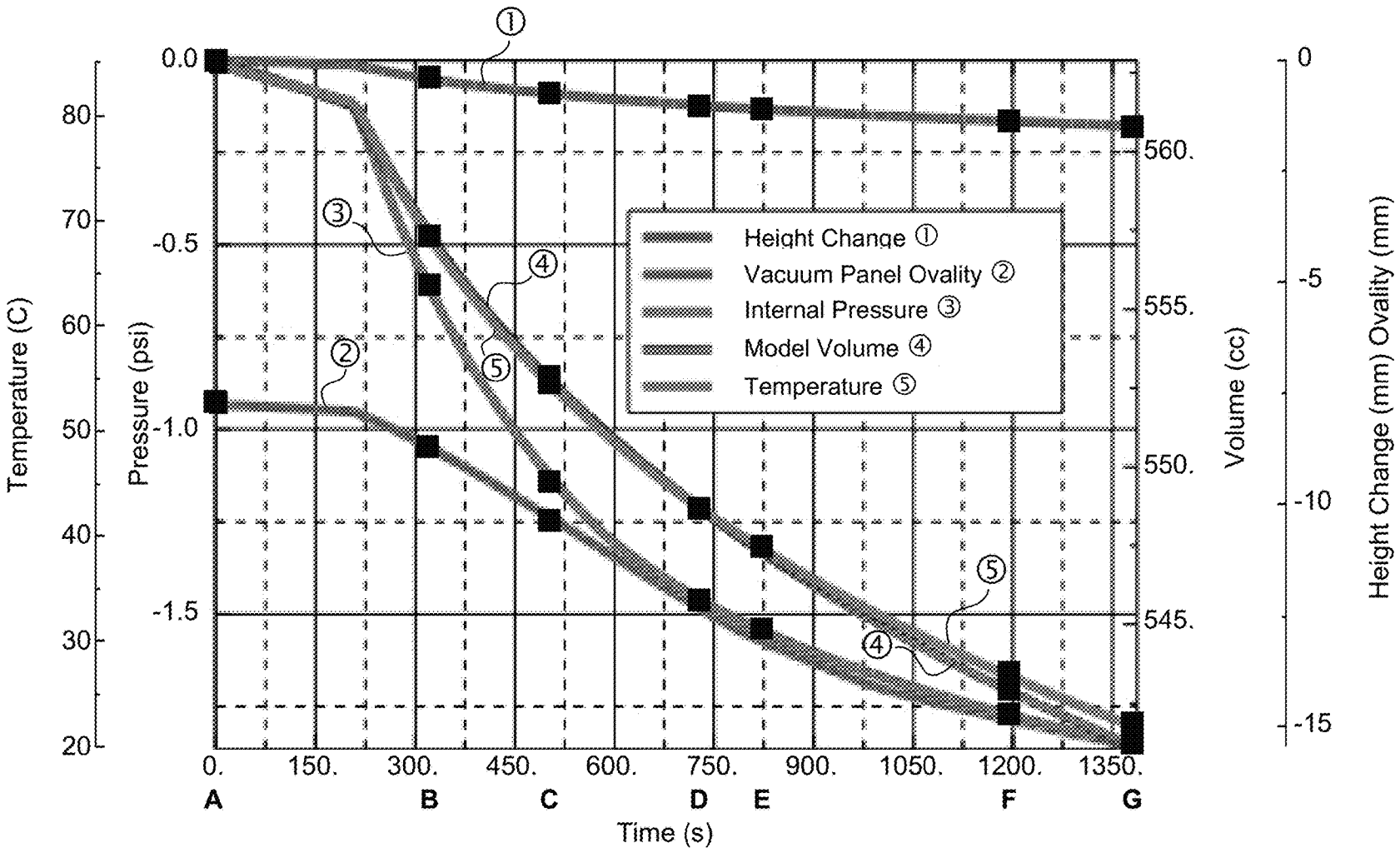
FIG. 8 is a graph showing the change of different variables over time as the temperature of the liquid cools.

FIG. 8 shows a graph detailing the change of six different container characteristics over time during container deformation as the liquid cools: change in container 1000's overall height (H), ovality of the first vacuum panels, internal container pressure, container volume, and liquid temperature.

Line 5 represents the change of the liquid temperature over time. Line 3 represents the change in the internal container pressure over time. As shown in FIG. 8, as time passes the liquid temperature cools and the internal pressure of container 1000 drops. FIG. 8 specifically calls out seven sequential time points for reference: time A, time B, time C, time D, time E, time F, and time G. Characteristics at other time points will be apparent from the graph and accompanying explanation.

FIGS. 9A, 10A, 11A, and 12A show various views of container 1000 at time A. FIGS. 9B, 10B, 11B, and 12B show various views of container at time B. FIGS. 9C, 10C, 11C, and 12C show various views of container at time C. FIGS. 9D, 10D, 11D, and 12D show various views of container at time D. FIGS. 9E, 10E, 11E, and 12E show various views of container at time E. FIGS. 9F, 10F, 11F, and 12F show various views of container at time F. FIGS. 9G, 10G, 11G, and 12G show various views of container at time G.

At time A, the liquid is still at its elevated temperature and there has been no drop in the internal pressure of container 1000.

FIG. 9A shows a cross-sectional view of container 1000 along longitudinal axis L of FIG. 3.

At time A the container 1000 is in its original shape and is un-deformed because there is no change in temperature or internal container pressure. Thus, FIG. 9A shows the un-deformed cross-sectional shape 1003A of container 1000 at longitudinal axis L. As the temperature of the liquid cools over time, the internal pressure of container 1000 also drops. As the internal container pressure drops, it becomes lower than the external surrounding pressure, creating a pressure differential (vacuum) that causes stress to the material of container 1000, causing it to deform.

Figure 9B:
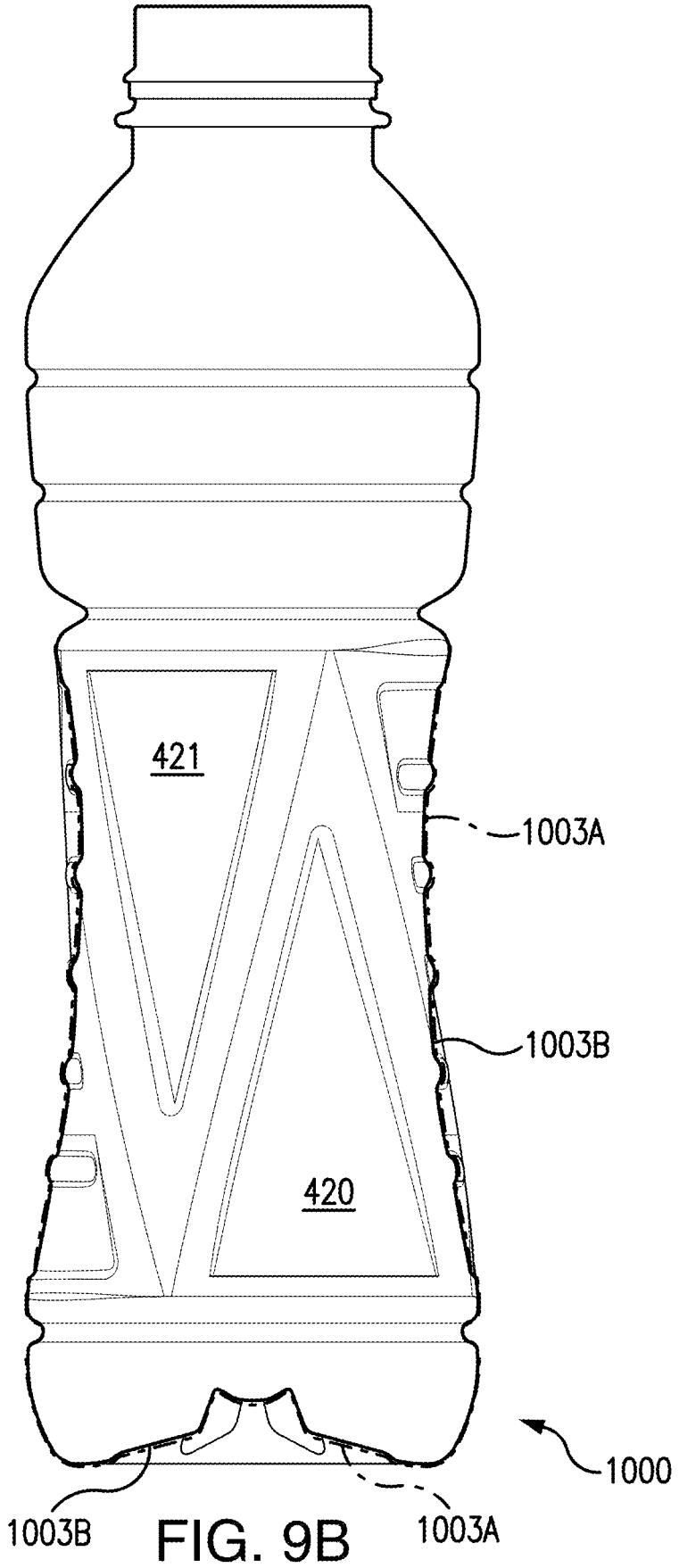
FIG. 9B is a cross-sectional view of the container of FIG. 9A at point B of the graph in FIG. 8 according to some embodiments.

For example, at time B in FIG. 8, the temperature of the liquid has cooled from its original temperature at time A and the internal container pressure has dropped from the original pressure at time A. FIG. 9B shows how the deformation changes cross-sectional shape 1003A. Dotted line 1003A represents the original, un-deformed cross-sectional shape and solid line 1003B represents the deformed cross-sectional shape.

Figure 9C:
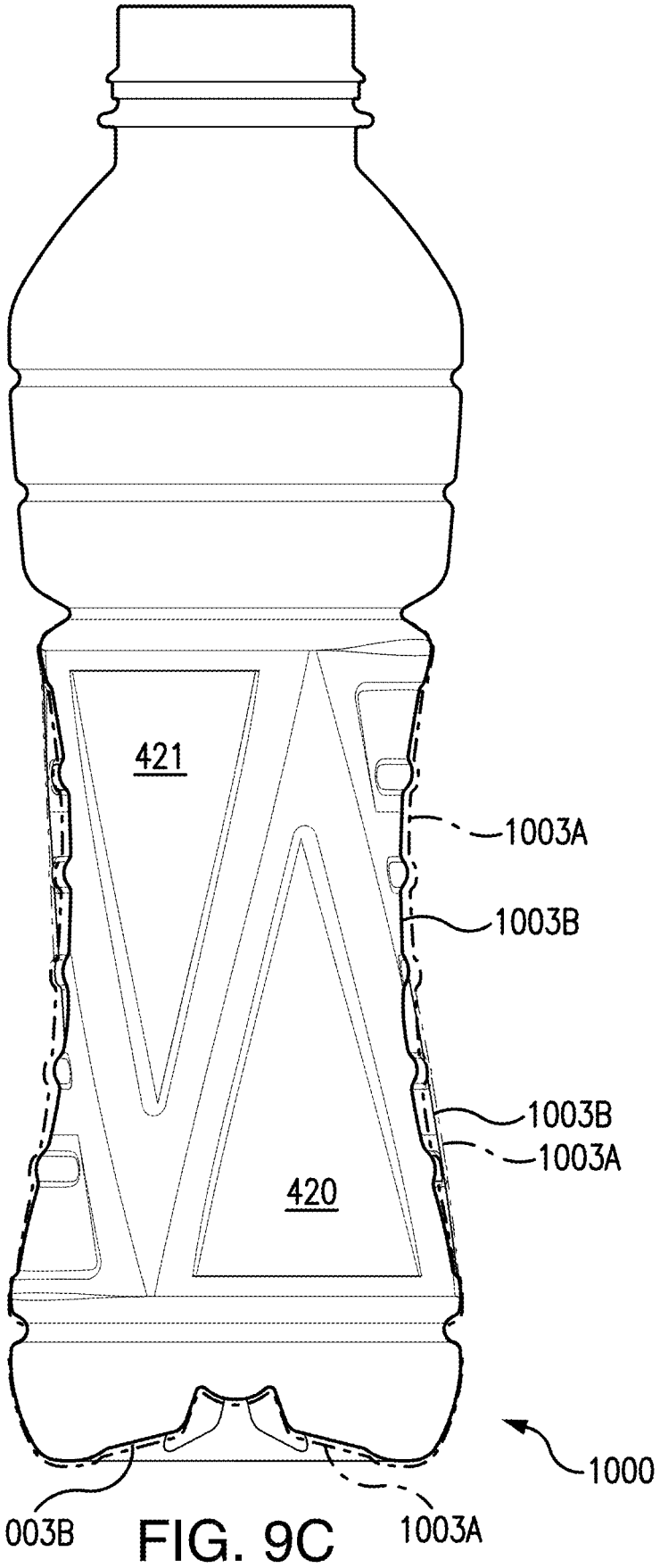
FIG. 9C is a cross-sectional view of the container of FIG. 9A at point C of the graph in FIG. 8 according to some embodiments.
Figure 9D:
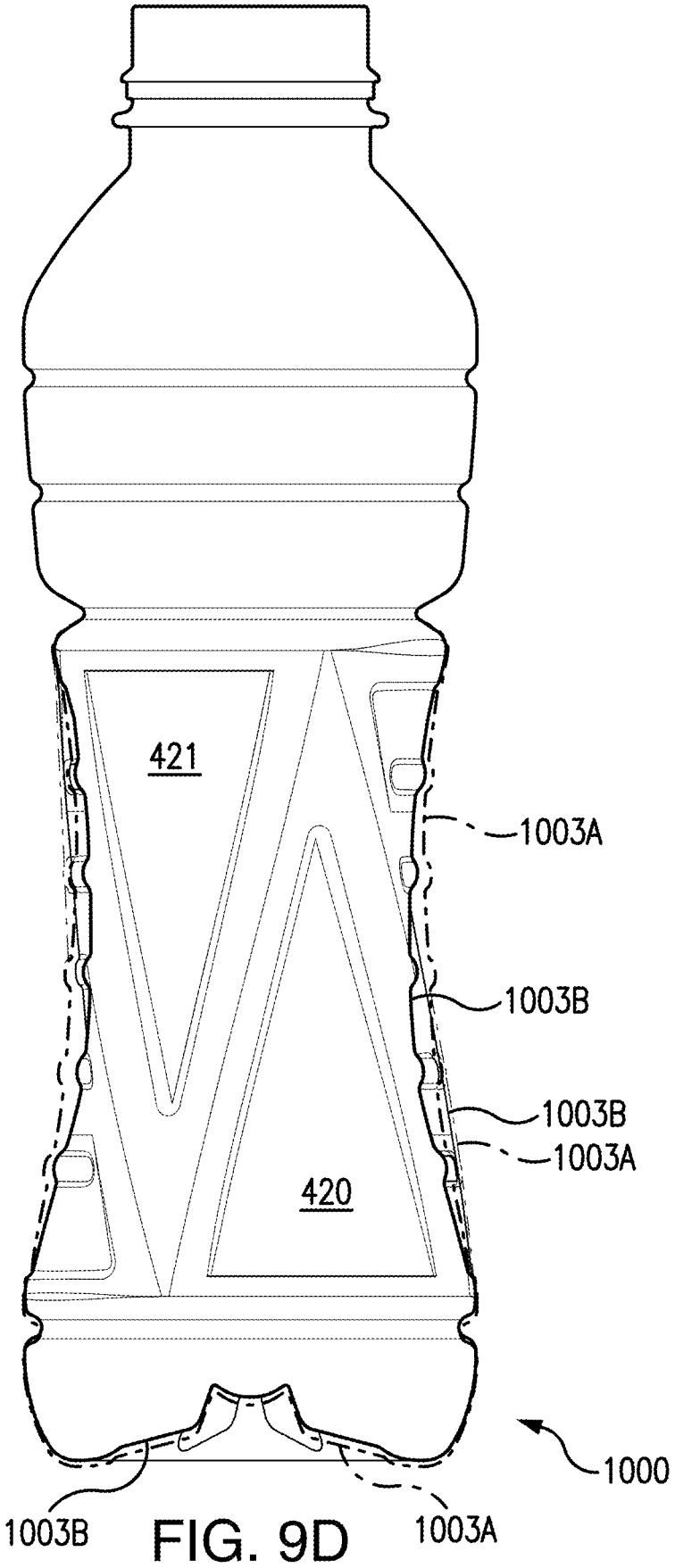
FIG. 9D is a cross-sectional view of the container of FIG. 9A at point D of the graph in FIG. 8 according to some embodiments.
Figure 9E:
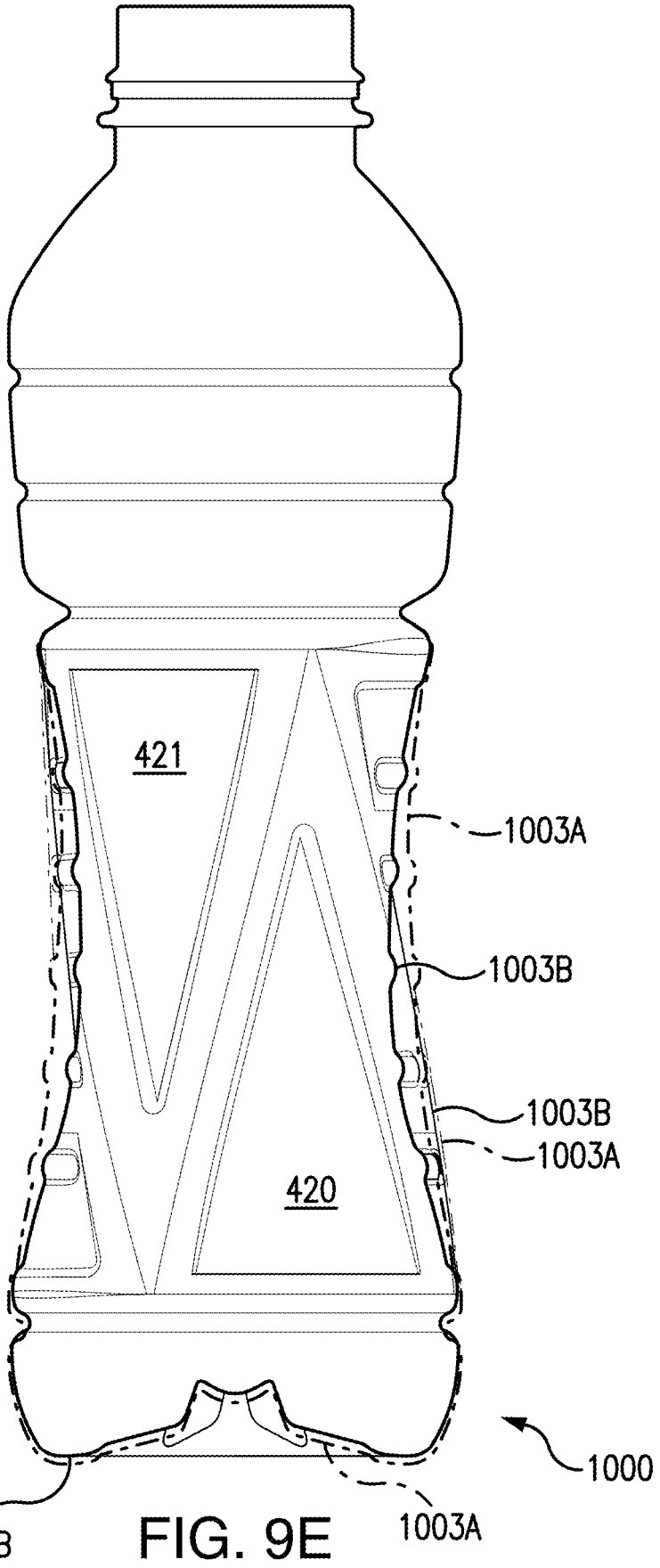
FIG. 9E is a cross-sectional view of the container of FIG. 9A at point E of the graph in FIG. 8 according to some embodiments.
Figure 9F:
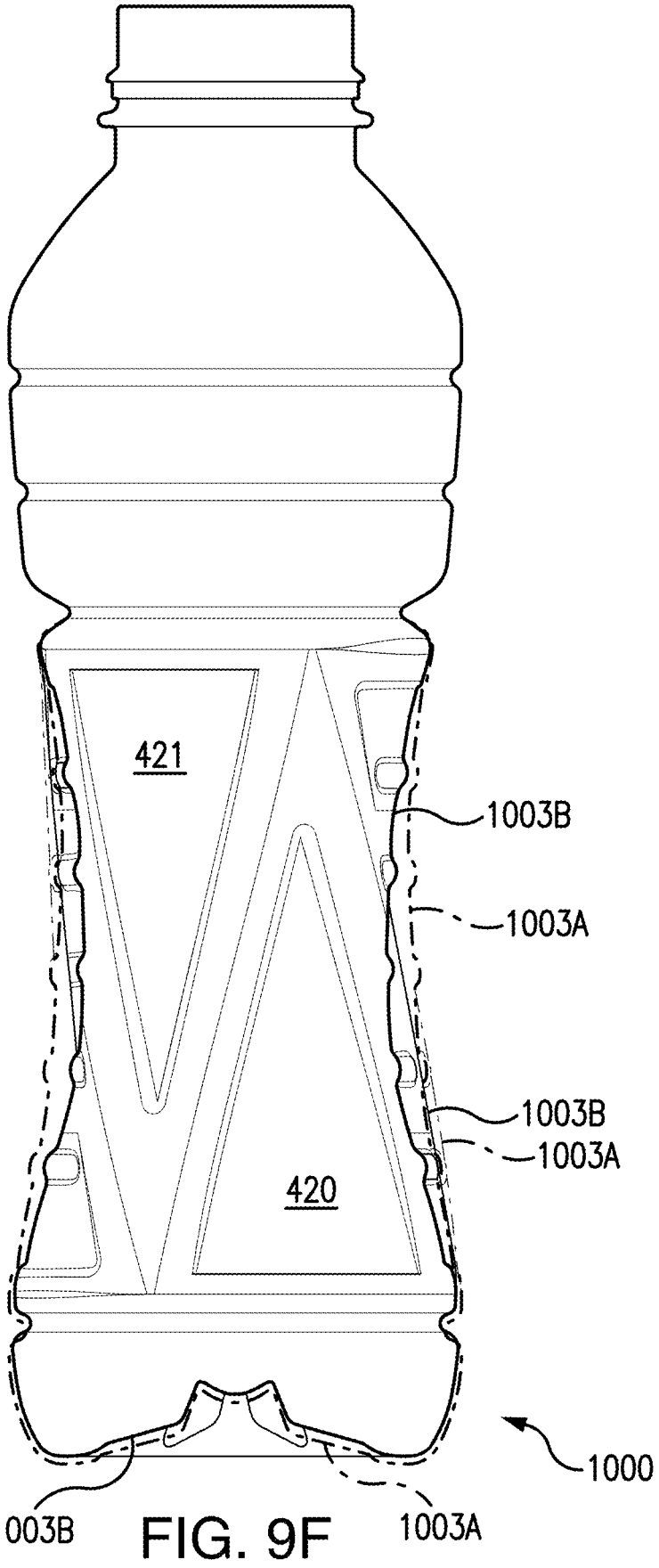
FIG. 9F is a cross-sectional view of the container of FIG. 9A at point F of the graph in FIG. 8 according to some embodiments.
Figure 9G:
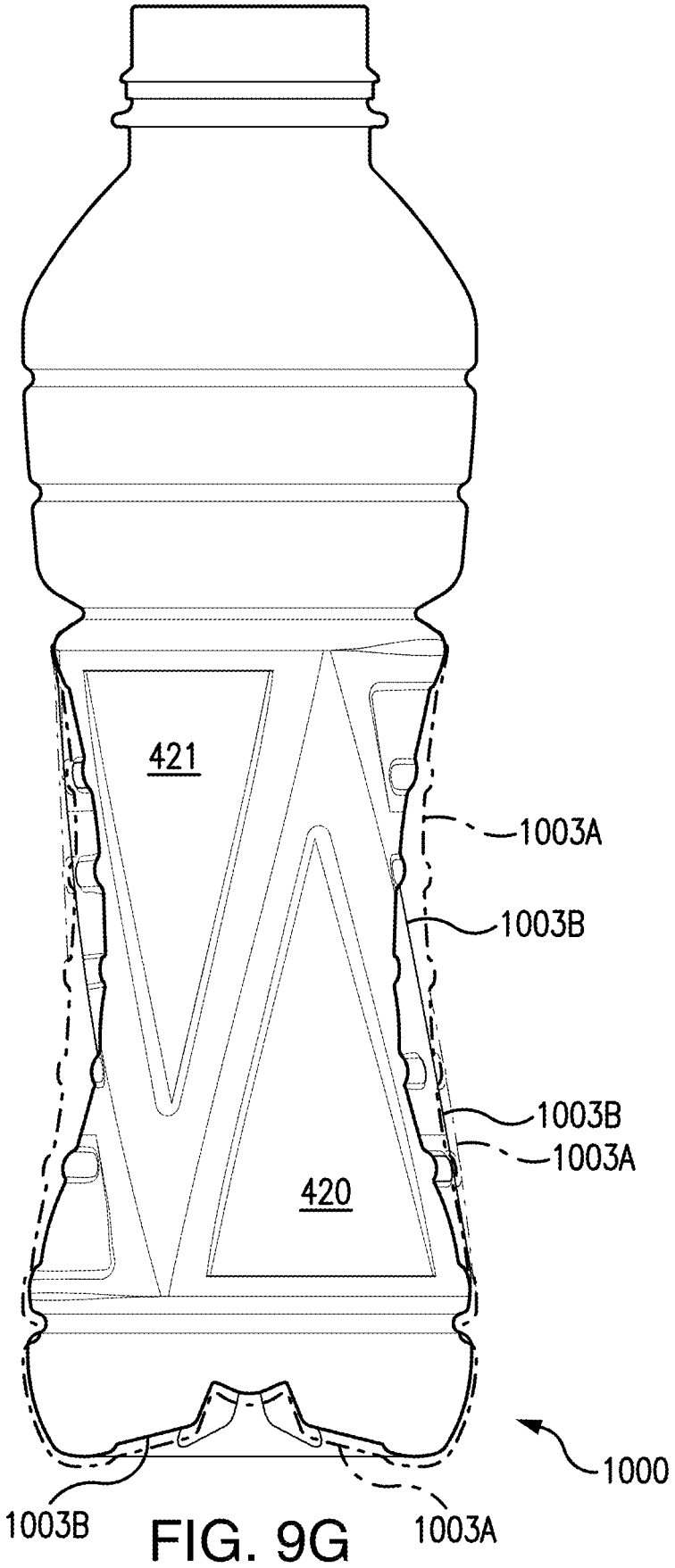
FIG. 9G is a cross-sectional view of the container of FIG. 9A at point G of the graph in FIG. 8 according to some embodiments.

Times C, D, E, F, and G involve progressively cooler liquid temperatures and progressively decreased internal container pressures. FIG. 9C shows the cross-sectional shape at time C, FIG. 9D shows the cross-sectional shape at time D, FIG. 9E shows the cross-sectional shape at time E, FIG. 9F shows the cross-sectional shape at time F, and FIG. 9G shows the cross-sectional shape at time G. Generally, FIGS. 9A-9G show that the sides of container 1000 including first vacuum panel 410 move in towards an interior of container 1000 as container 1000 deforms. Additionally, FIGS. 9A-9G show that the bottom surface of container 1000 upon which container 1000 sits also slightly flexes in towards the interior of container 1000 as the internal pressure of container 1000 drops.

The amount of flex of bottom surface of base portion 500 is small relative to the flex experienced by body portion 400. Because the vacuum panels are designed to concentrate the stresses only to that area of container 1000, the other portions of container 1000 do not experience substantial stress or deformation. Thus, due to the vacuum panels, the change in shape of the other portions due to a change in internal container pressure, including the base portion 500, is relatively small. Thus, the deformation of container 1000 is mostly contained to body portion 400.

FIGS. 9A-9G also show that the cross-sectional shape of the other portions of container 1000, such as neck portion 200, and shoulder portion 300, and base portion 500, do not deform as much relative to the deformation experienced by the body portion 400. In some embodiments the shape of the other portions of container 1000, such as neck portion 200, shoulder portion 300, and base portion 500, do not deform at all (or not appreciably) relative to the deformation experienced by the body portion 400.

In some embodiments, the small deformation of other portions of container 1000 compared to the deformation of body portion 400 may be quantified by determining how much that portion has flexed in towards an interior of container 1000 compared to how much first vacuum panel 410 has flexed. For example, in some embodiments, the amount of flex (e.g., deformation displacement) experienced by bottom surface of base portion 500 after deformation is, at most, 10% of the amount of flex experienced by body portion 400 at first vacuum panel 410 after deformation. In some embodiments, the amount of flex experienced by bottom surface of base portion 500 is at most 5% of the amount of flex experienced by body portion 400 at first vacuum panel 410. In some embodiments, the amount of flex experienced by bottom surface of base portion 500 is at most 2% of the amount of flex experienced by body portion 400 at first vacuum panel 410.

In some embodiments, the deformation displacements may be compared by determining what percentage of container 1000's volume reduction is contributed to the deformation of body portion 400.

For example, when the liquid cools, its volume is reduced (e.g., by 3-5%). Thus, in some embodiments, the flexing of the body portion 400 decreases container 1000's initial volume by 3%. In some embodiments, the initial volume is decreased by 5%. In some embodiments, at least 85% of the decrease in container 1000's initial volume is due to the deformation of body portion 400. In some embodiments at least 90% of the decrease in initial container volume is because of deformation of body portion 400. In some embodiments, at least 95% of the decrease in initial container volume is due to deformation of body portion 400.

FIGS. 10A-10G, 11A-11G, and 12A-12G represent the stresses on some portions of the container 1000 relative to other portions of container 1000 at times A, B, C, D, E, F, and G, respectively. More stippling (e.g., appearing darker) in these figures represents a relatively higher amount of stress (e.g., von Mises stresses) than less stippling (e.g., appearing lighter or without stippling). The legend A provides a relative reference for relating the depicted stippling to relatively lower and relatively higher stress on one region of the container to the other.

Figure 10A:
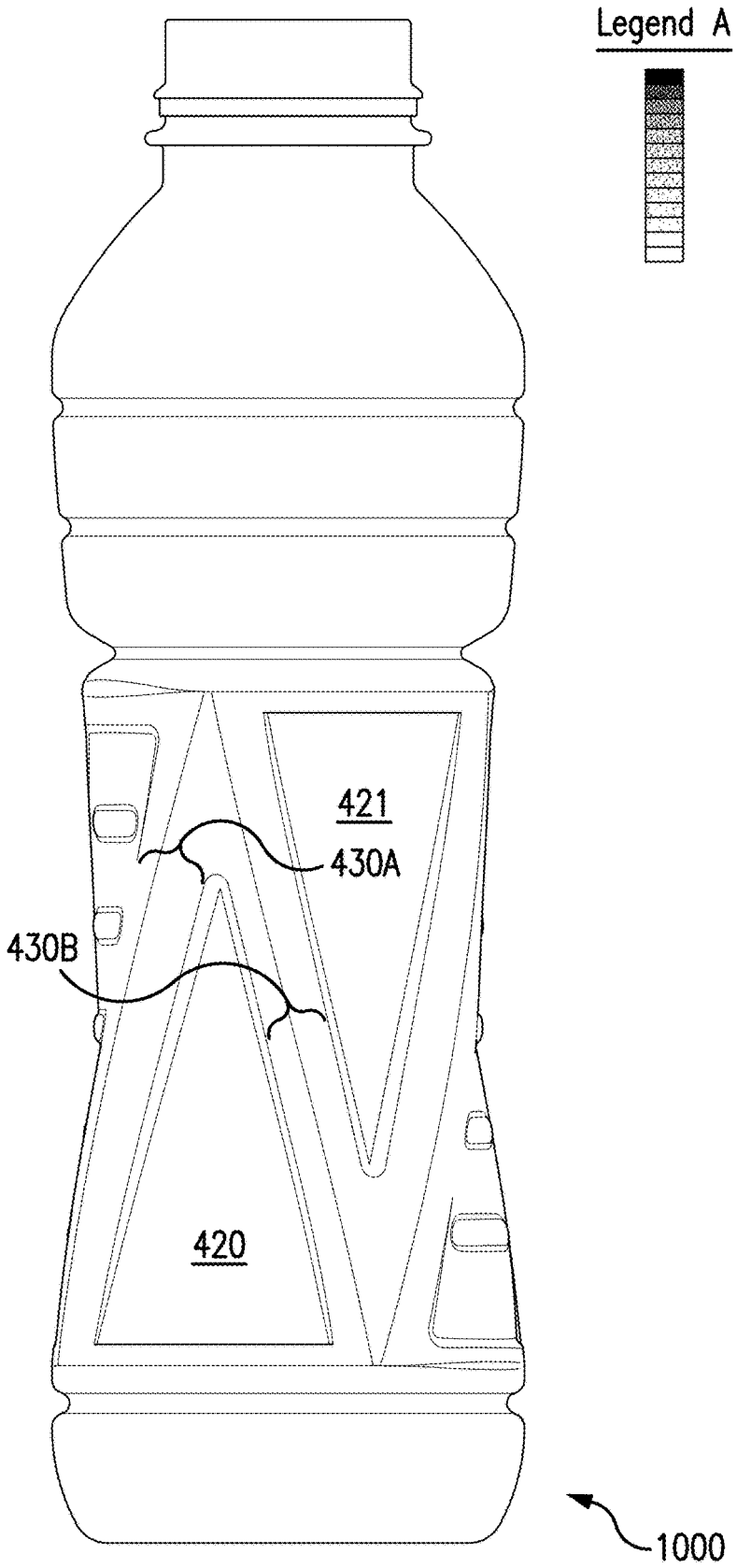
FIG. 10A illustrates the stresses on the right side of a container at point A of the graph in FIG. 8 according to some embodiments.
Figure 10B:
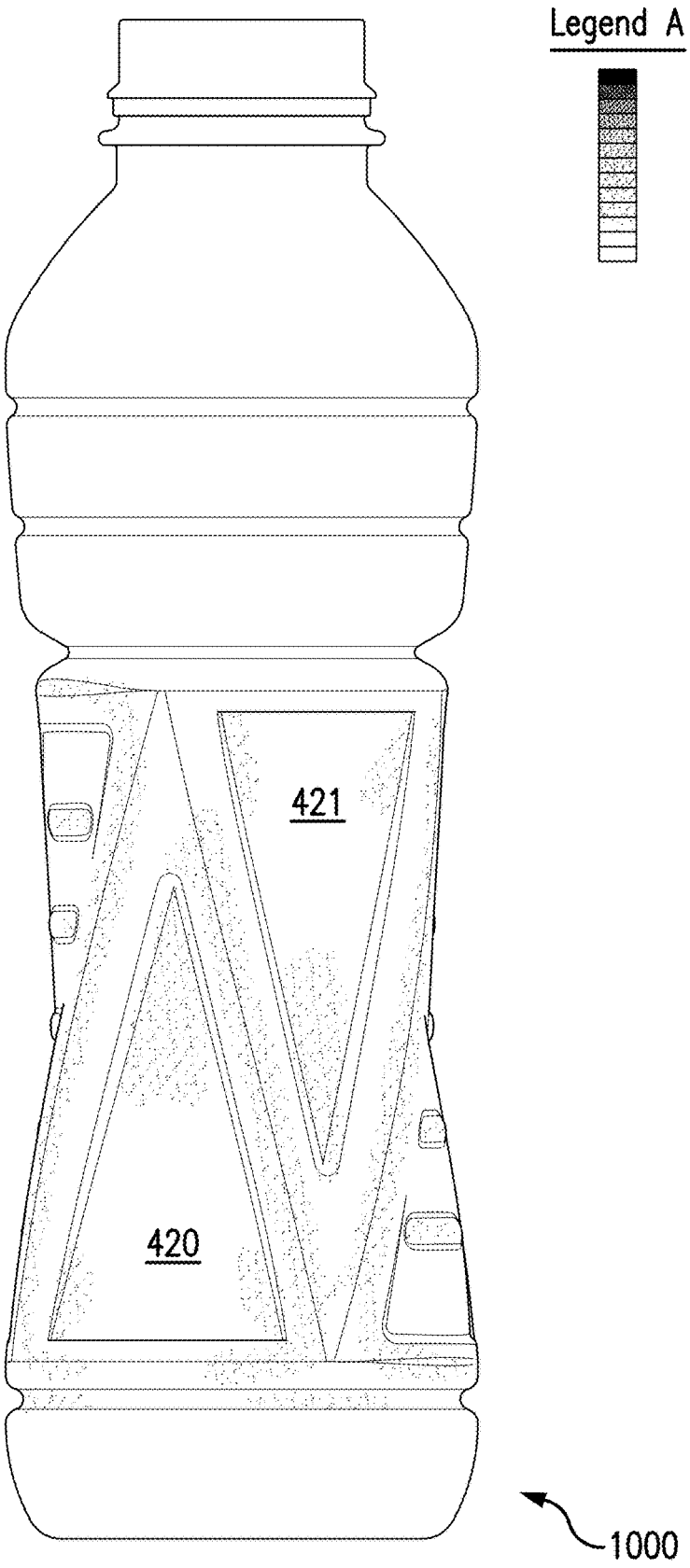
FIG. 10B illustrates the container of FIG. 10A at point B of the graph in FIG. 8 according to some embodiments.
Figure 10C:
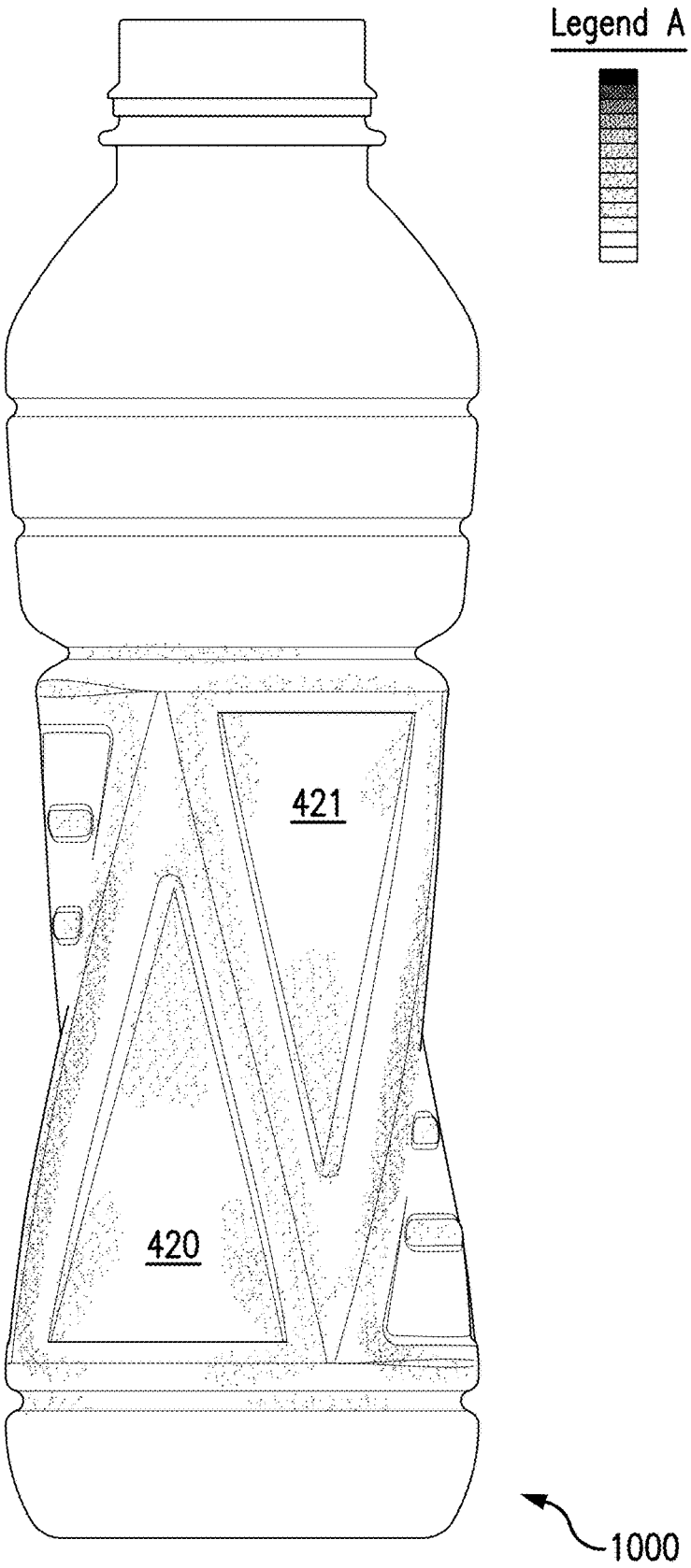
FIG. 10C illustrates the container of FIG. 10A at point C of the graph in FIG. 8 according to some embodiments.
Figure 10D:
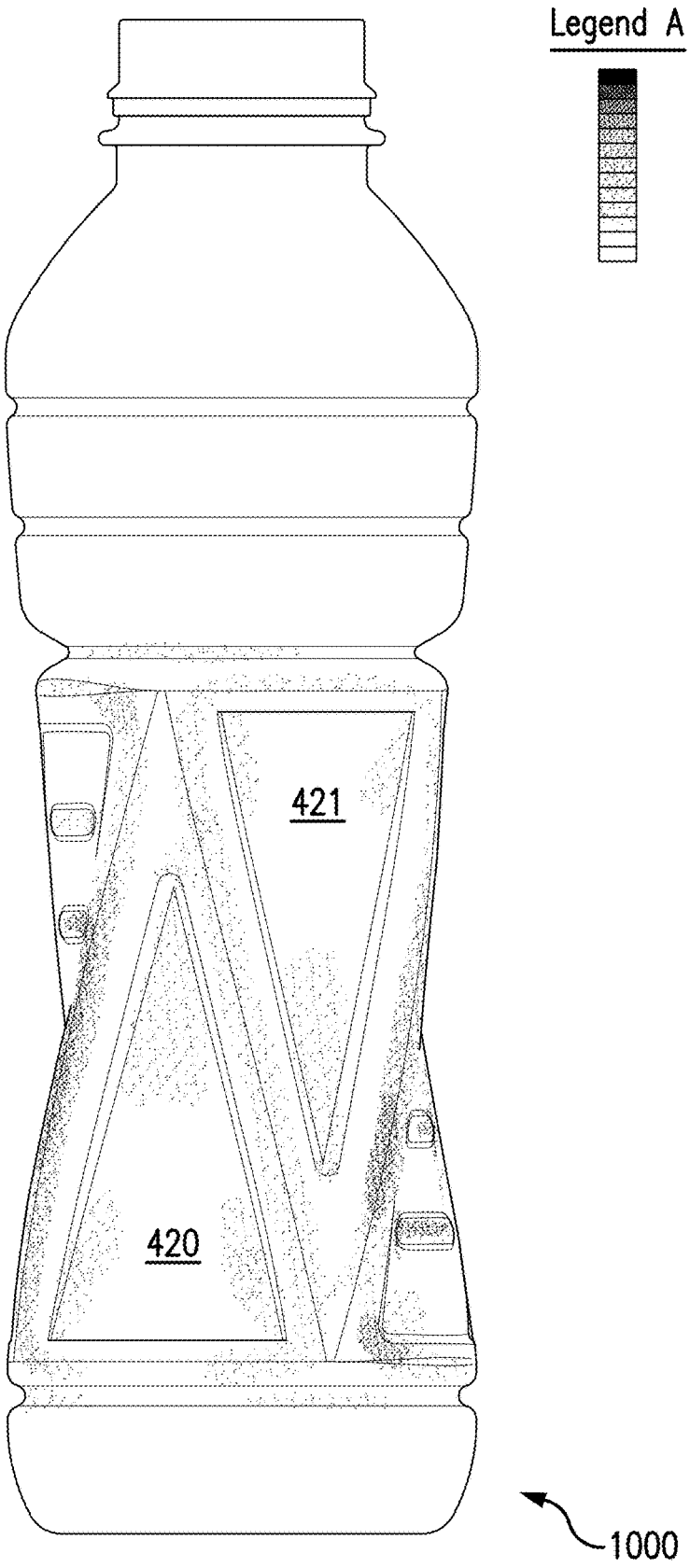
FIG. 10D illustrates the container of FIG. 10A at point D of the graph in FIG. 8 according to some embodiments.
Figure 10E:
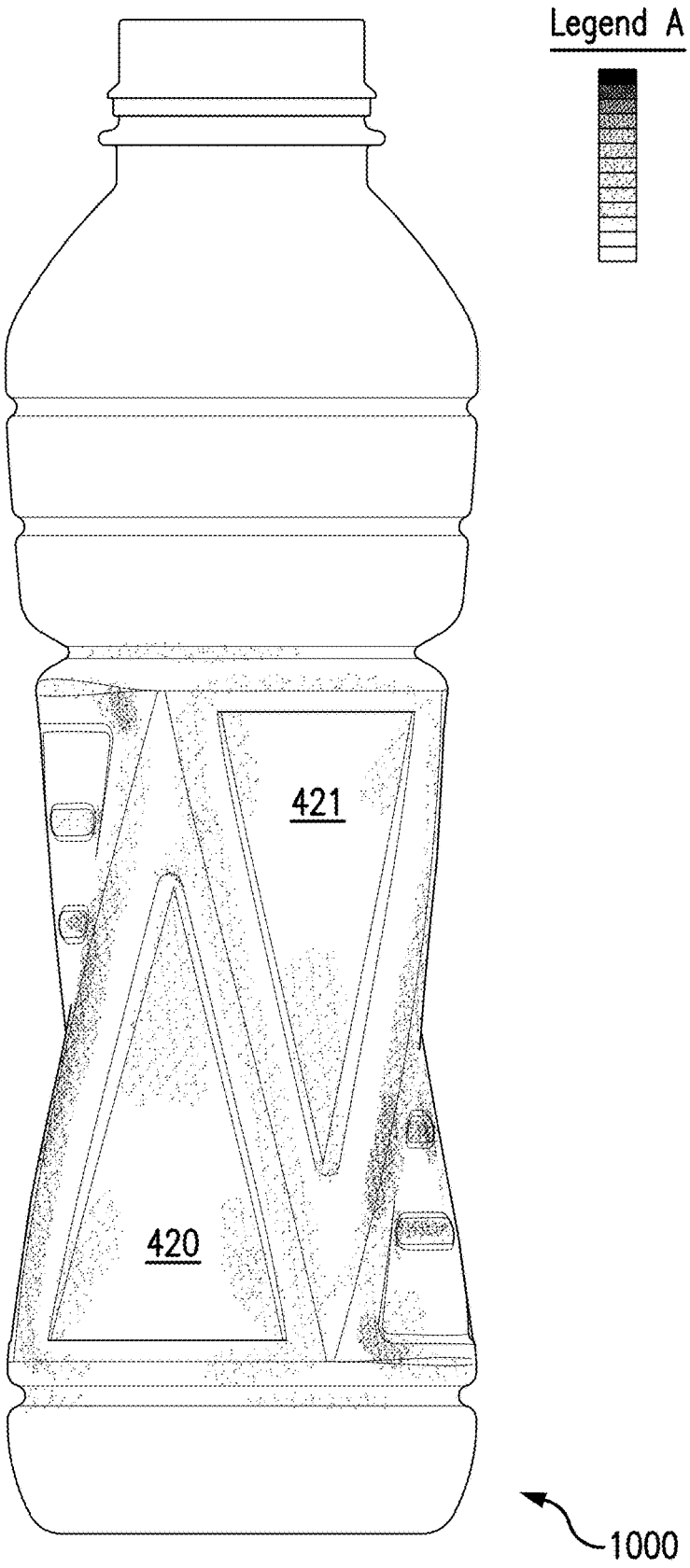
FIG. 10E illustrates the container of FIG. 10A at point E of the graph in FIG. 8 according to some embodiments.
Figure 10F:
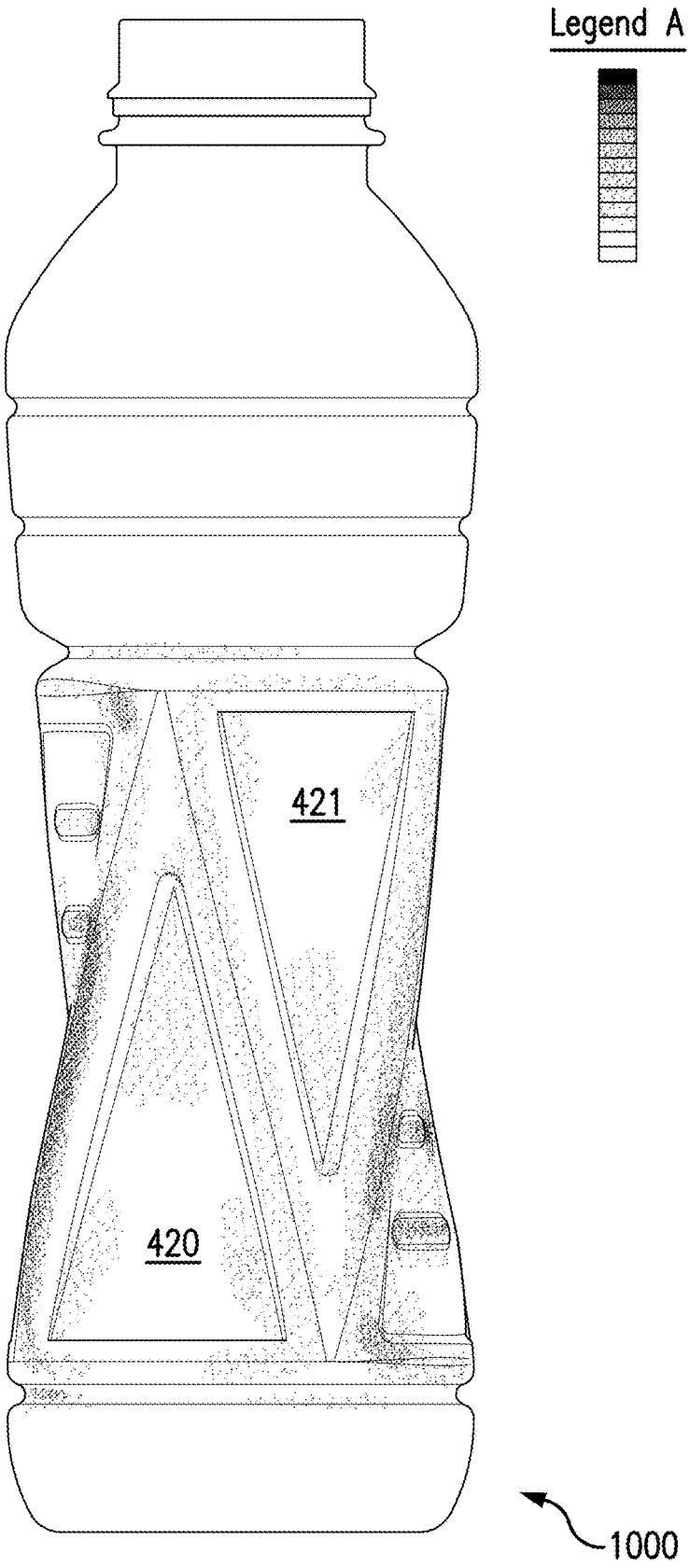
FIG. 10F illustrates the container of FIG. 10A at point F of the graph in FIG. 8 according to some embodiments.
Figure 10G:
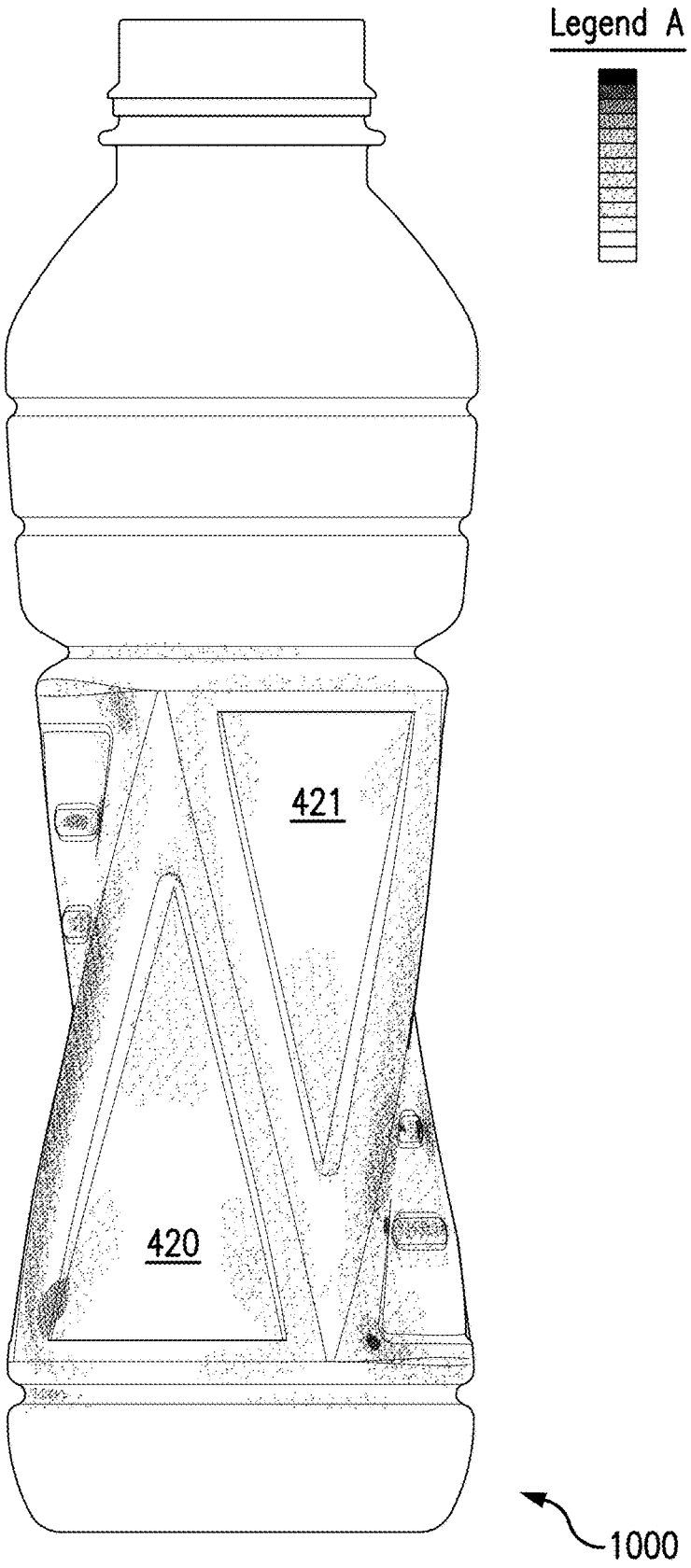
FIG. 10G illustrates the container of FIG. 10A at point G of the graph in FIG. 8 according to some embodiments.
Figure 11A:
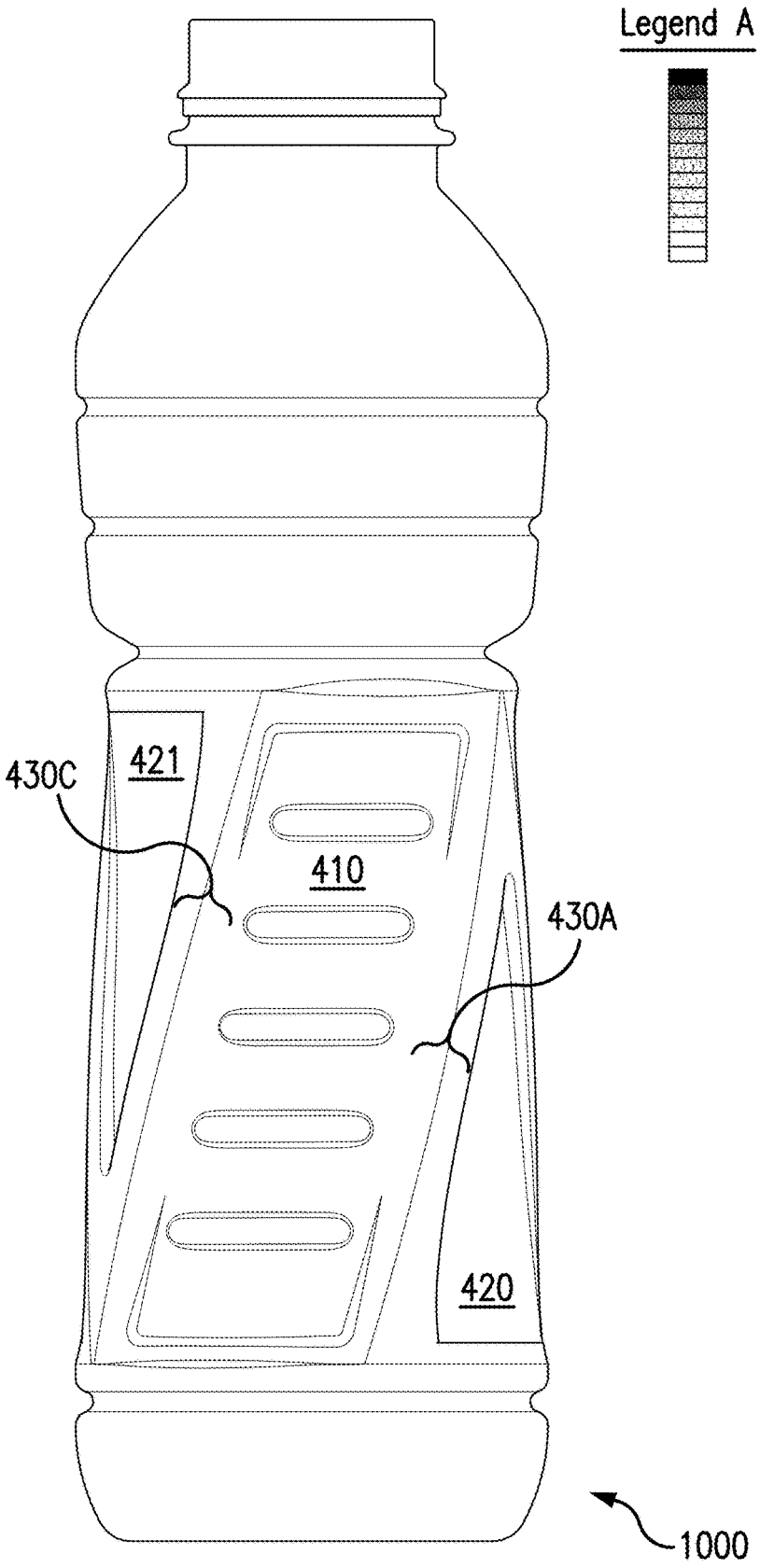
FIG. 11A illustrates the stresses on the front of a container at point A of the graph in FIG. 8 according to some embodiments.
Figure 11B:
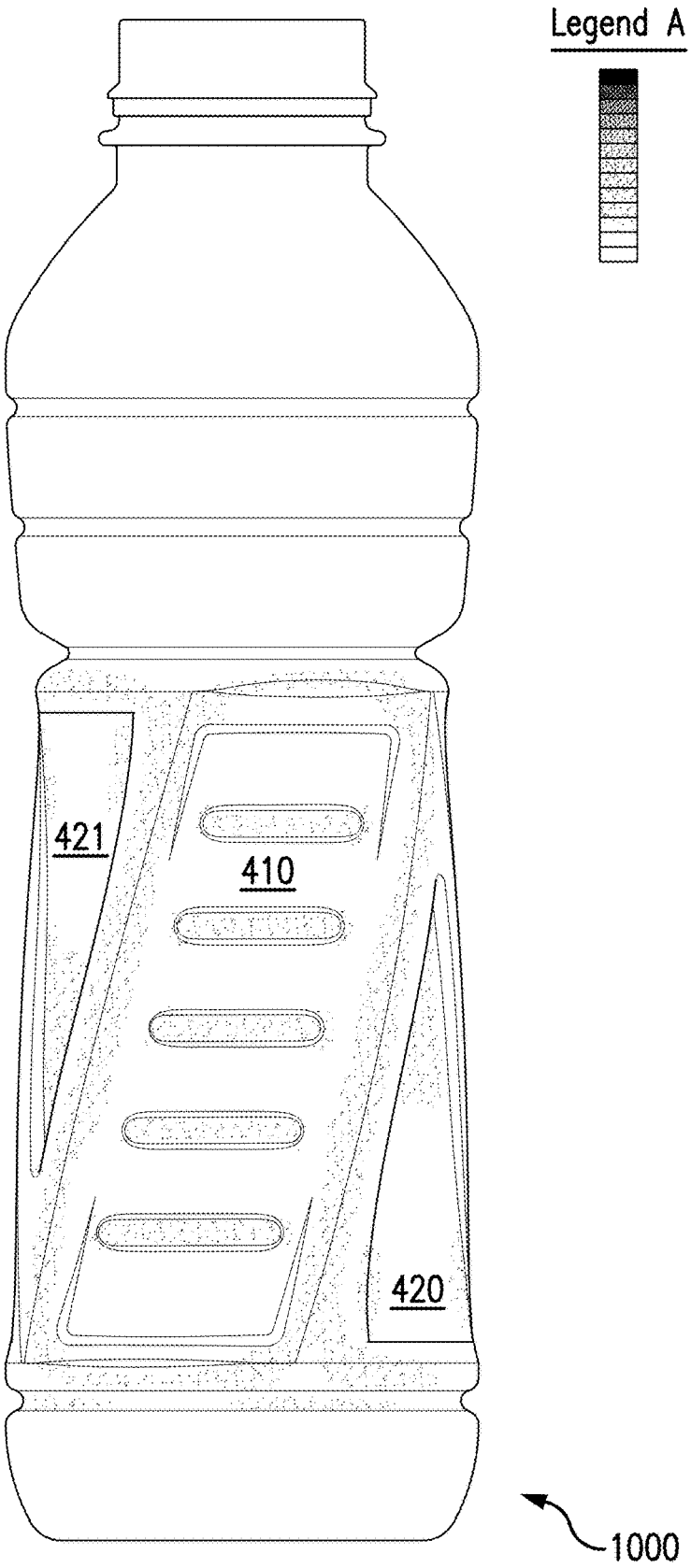
FIG. 11B illustrates the container of FIG. 11A at point B of the graph in FIG. 8 according to some embodiments.

FIGS. 10A-10G show the stresses on the right side of container 1000. FIGS. 11A-11G show the stresses on the front side of container 1000. At time A, there is no change in temperature or internal container pressure so FIGS. 10A and 11A do not have any stippled portions. At time B, the temperature of the liquid has cooled from its original temperature and the internal container pressure has dropped. Thus, at time B, the corners of second vacuum panel 420 and third vacuum panel 421 experience stress, as shown in FIG. 10B, and the middle portions of first vacuum panel 410 experience stress, as shown in FIG. 11B. Additionally, first column 430A, second column 430B, and third column 430C also experience stress.

Figure 11C:
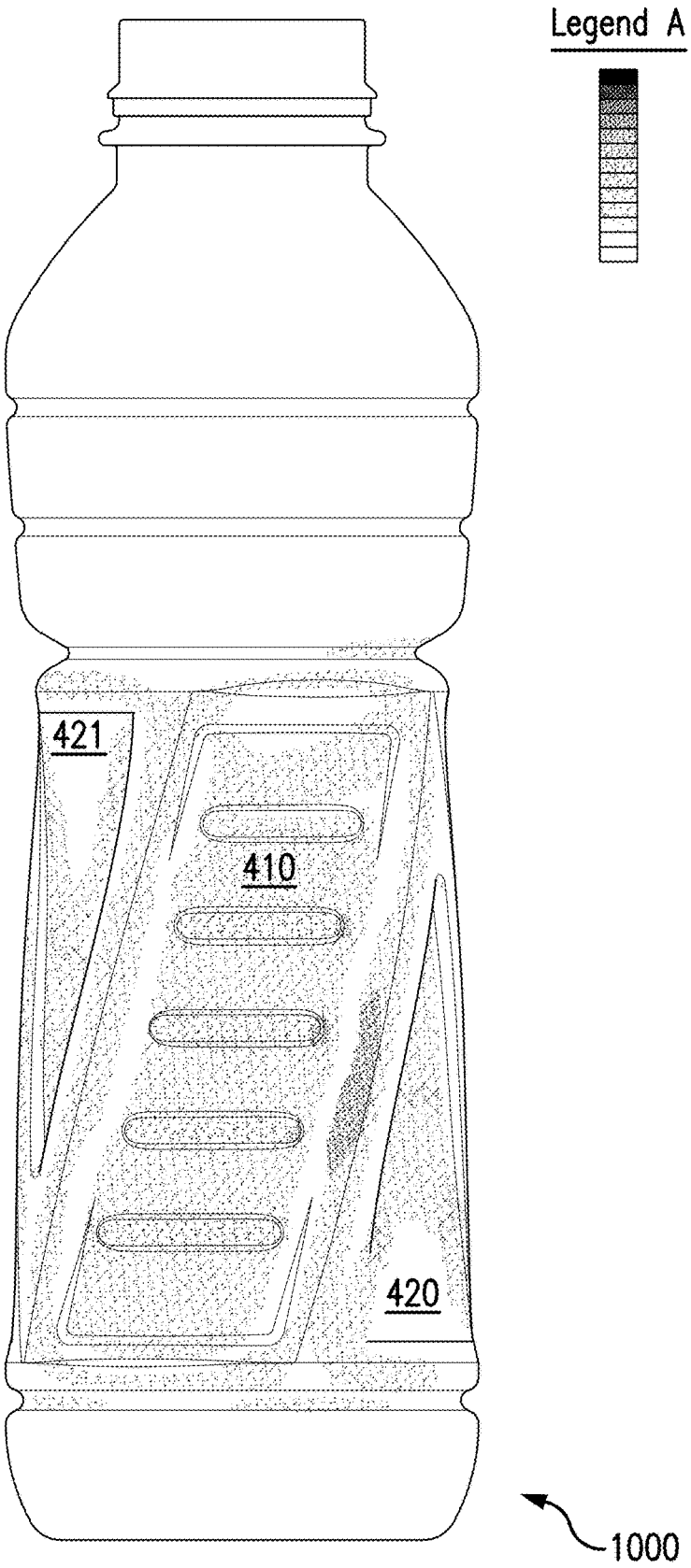
FIG. 11C illustrates the container of FIG. 11A at point C of the graph in FIG. 8 according to some embodiments.

As the temperature of the liquid further cools and the internal pressure of container 1000 further drops, for example, at time C, more portions of first vacuum panel 410, second vacuum panel 420, and third vacuum panel 421 start to experience stress. While first vacuum panel 410, second vacuum panel 420, and third vacuum panel 421 all experience some amount of stress, the stress experienced by first vacuum panel 410 increases at a faster rate than the stress experienced by second vacuum panel 420 and third vacuum panel 421. Additionally, the portions of the panels that experience stress spread more quickly in first vacuum panel 410 than in second vacuum panel 420 or third vacuum panel 421. For example, a comparison between FIG. 10C and FIG. 11C shows that almost the entirety of first vacuum panel 410 experiences stress at time C while the stress experienced by second vacuum panel 420 and third vacuum panel 421 is contained to the corners of second vacuum panel 420 and third vacuum panel 421.

Figure 11D:
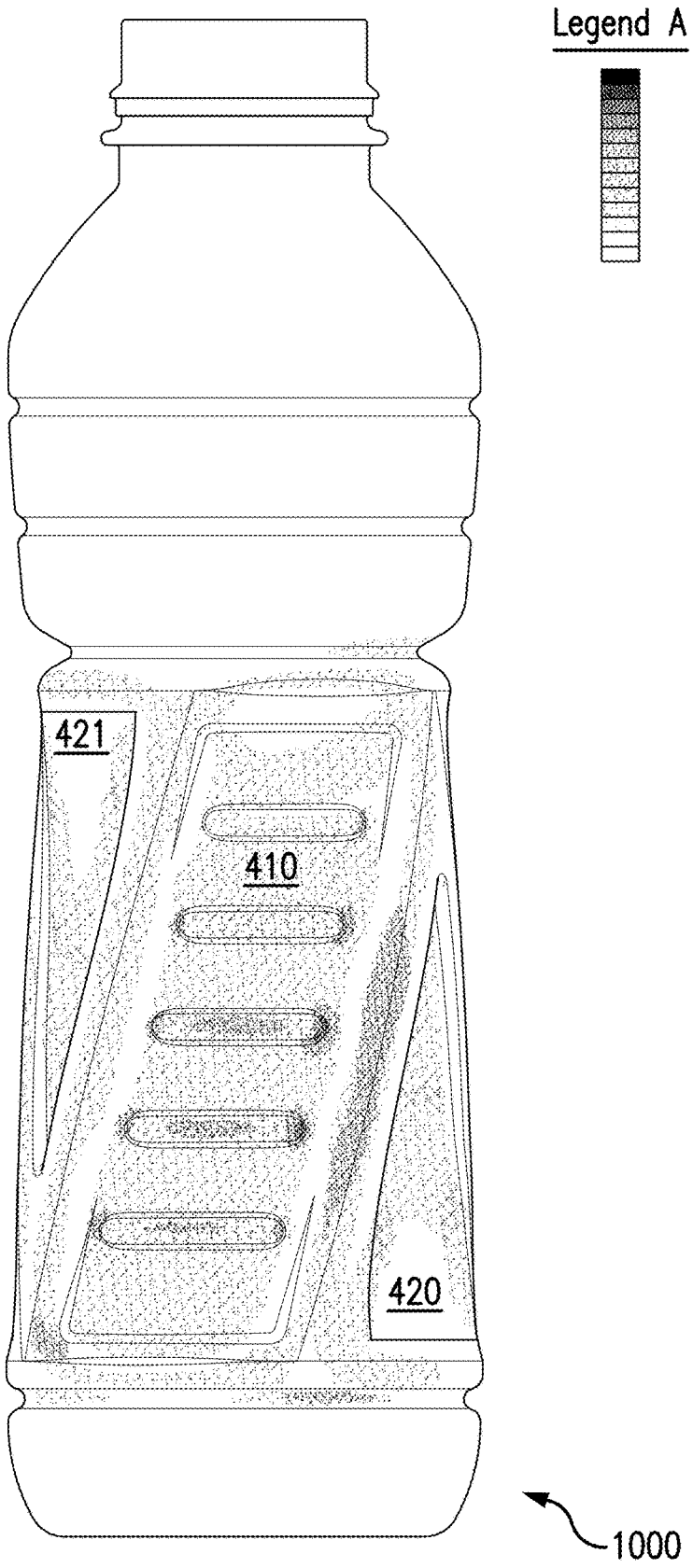
FIG. 11D illustrates the container of FIG. 11A at point D of the graph in FIG. 8 according to some embodiments.
Figure 11E:
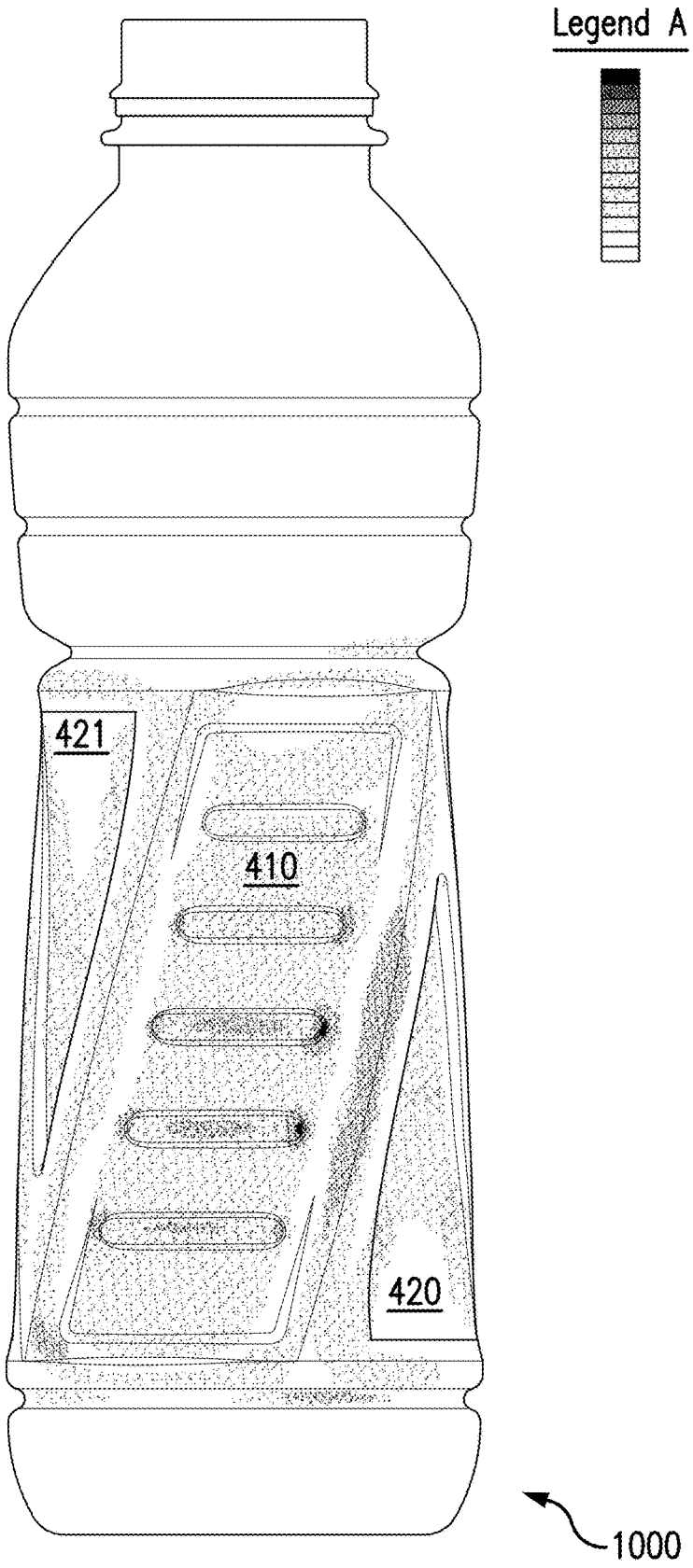
FIG. 11E illustrates the container of FIG. 11A at point E of the graph in FIG. 8 according to some embodiments.
Figure 11F:
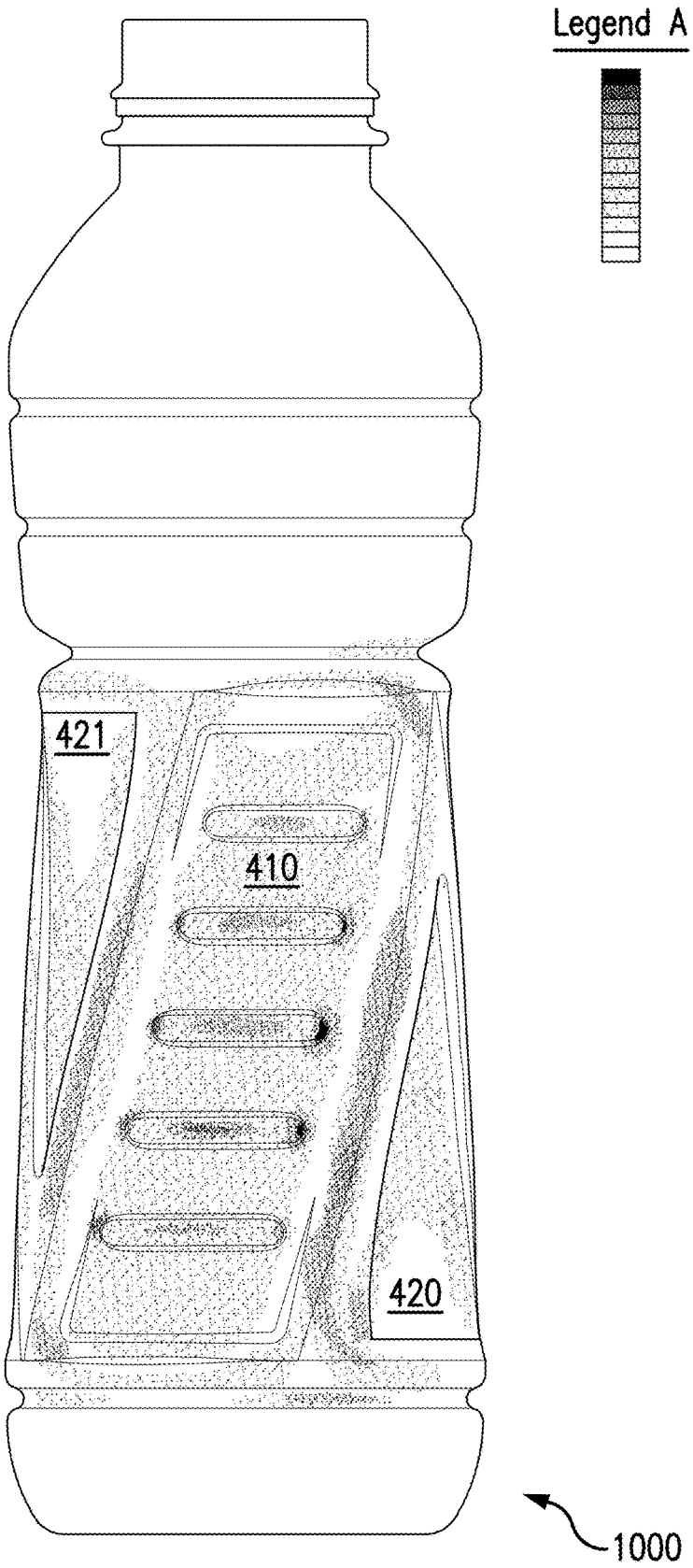
FIG. 11F illustrates the container of FIG. 11A at point F of the graph in FIG. 8 according to some embodiments.
Figure 11G:
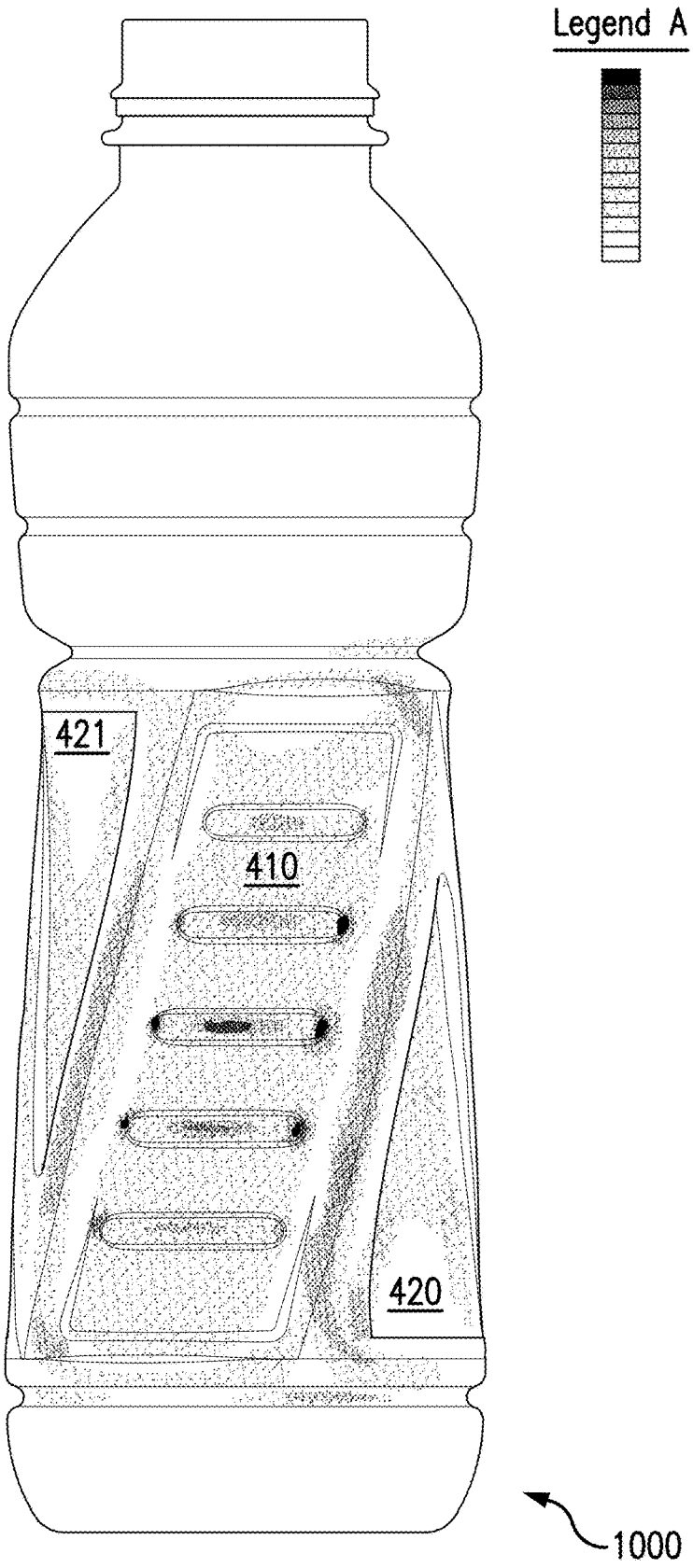
FIG. 11G illustrates the container of FIG. 11A at point G of the graph in FIG. 8 according to some embodiments.

Times D, E, F, and G involve progressively cooler liquid temperatures and progressively decreased internal container pressures. FIGS. 10D and 11D correspond to time D in FIG. 8. FIGS. 10E and 11E correspond to time E in FIG. 8. FIGS. 10F and 11F correspond to time F in FIG. 8. FIGS. 10G and 11G correspond to time Gin FIG. 8.

Generally, FIGS. 10A-10G and FIGS. 11A-11G show that the portions of container 1000 that experience the most stress during deformation is first vacuum panel 410. While second vacuum panel 420 and third vacuum panel 421 also experience stress, the stress is concentrated at the corners of the second vacuum panel and third vacuum panel. FIGS. 10A-10G and FIGS. 11A-11G also show that stress is experienced by first column 430A, second column 430B, and third column 430C. However, the first column 430A and third column 430C experience more stress than second column 430B.

These figures also show that the stresses on the container 1000 during the cooling process are mostly concentrated in body portion 400. In some embodiments, greater than 50% of the stresses on the container 1000 during the cooling process are concentrated in body portion 400. In some embodiments, greater than 75% of the stresses are concentrated in body portion 400. In some embodiments, greater than 90% of the stresses are concentrated in body portion 400.

Figure 12G:
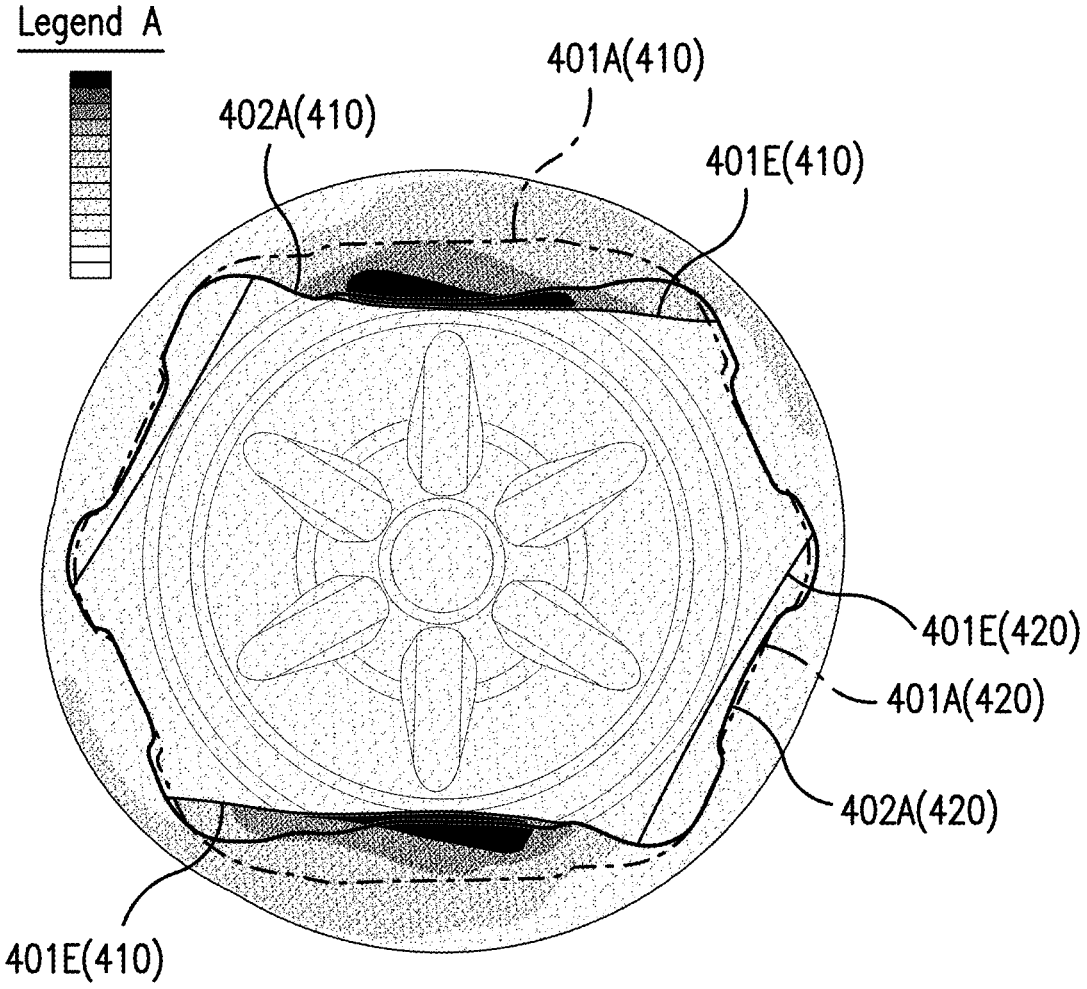
FIG. 12G is a cross-sectional view of the container of FIG. 12A at point G of FIG. 8 according to some embodiments.

FIGS. 12A-12G show a cross-section of container 1000 at line A-A before flexing (FIG. 12A), during flexing (FIGS. 12B-12F), and after flexing (FIG. 12G). For clarity, some container portions that are labeled in FIG. 12A, such as first, second, and third columns 430A-C, are unlabeled in FIGS. 12B-12G. The stippling in FIGS. 12A-12G represents the stress on some portions of the container 1000 relative to other portions of container 1000. More stippling (e.g., appearing darker) represents a relatively higher amount of stress (e.g., von Mises stresses) than less stippling (e.g., appearing lighter or without stippling). Legend A provides a relative reference for relating the depicted stippling to relatively lower and relatively higher stresses on one region of the container to the other.

As shown in FIG. 12A, the body portion 400 has a cross-sectional oval shape 401A at line A-A in FIG. 3 before flexing. Oval shape 401A has different portions which are represented by the number in the parenthesis. For example, 401A (410) indicates the portion of 401A that corresponds to first vacuum panel 410 and 401A (421) indicates the portion of 401A that corresponds to third vacuum panel 421.

As body portion 400 flexes, the cross-sectional shape 401A changes to 402A. This change includes a flexing of first vacuum panels 410 in towards an interior of container 1000 at line A-A and a slight flexing of second vacuum panels 420 and third vacuum panels 421 in towards an interior of container 1000. As can be seen by FIGS. 12A-12G, the flexing of cross-sectional shape of container 1000 at line A-A is mostly done by first vacuum panels 410.

FIGS. 12A-12G also show lines 401E (410) and 401E (420). 401E represents the cross section of container 1000 at line E-E in FIG. 3. These portions are visible in FIGS. 12A-12G because they are at locations that are closer to an interior of container 1000 than 401A (410) and 401A (420) and are not to be blocked by circumference 401A. 401E (410) corresponds to the portion of first vacuum panel 410 at horizontal cross-section E-E in FIG. 3. 401E (420) corresponds to the portion of second vacuum panel 420. The portion of third vacuum panel 421 at line E-E is not shown in FIGS. 12A-12G because it is located at a position that is further away from the interior of container 1000 and is blocked by circumference 401A. Generally, FIGS. 12A-12G show that portions 401E (420) and 401E (410) also flex in towards the interior of container 1000 as container 1000 deforms. This may also be seen in FIGS. 12A-12G, indicated by 401E (420).

As shown in FIG. 13A, second vacuum panel 420 has an upper surface 4201 near angle 420A and a lower surface 4200 near base 420B. Lower surface 4200 corresponds to cross-section E-E in FIG. 3. Thus, as seen in FIG. 12A, lower surface 4200 in an un-deformed location is already at a position that is closer to the interior of container 1000 than the cross-section 401A. As second vacuum panel 420 experiences stresses, lower surface 4200 (represented by line 401E (420)) begins to move in further towards an interior of container 1000. As shown in FIG. 13A, third vacuum panel 421 also has an upper surface 4210 near base 421B and a lower surface 4211 near angle 421A. Although not shown, upper surface 4210 of third vacuum panel 421 acts in a similar manner as lower surface 4200 of second vacuum panel 420 as container 1000 deforms. This may because third vacuum panel 421 is oriented in an opposite vertical direction than second vacuum panel 420.

As the panels experience stress and start to flex inwards, the shape of the panels' surfaces also change in response to the stress and flex. FIGS. 13A-13C, FIG. 14A-14C, FIGS. 15A-15B, and FIGS. 16A-16F show the changes in shape of each panel.

FIGS. 14A-14C, FIGS. 15A-15B, and FIGS. 16A-16F show the change in shape of first vacuum panel 410 as it deforms. As first vacuum panel 410 flexes in towards the interior of container 1000, the concavity of its surfaces also increases. This may also be seen in FIGS. 12A-12G, where portion 410 of line 402A is substantially more curved than portion 410 of line 401A. In other words, portion 410 of line 402A has curved in towards an interior of container.

An increase in concavity may be seen when different portions of one horizontal cross section move in towards the interior of container 1000 by different amounts. In other words, first vacuum panel 410 does not move in towards the interior of container 1000 by the same amount along the same horizontal cross section.

For example, FIG. 16A shows a schematic representation of a surface of first vacuum panel 410 along one horizontal cross section of first vacuum panel 410. As the surface flexes, portions of the surface move in towards an interior of container 1000. However, the portions move in towards an interior of the container by different amounts. This may be characterized as an increase in the surface's concavity. FIGS. 16B-16F are representations of how different horizontal cross sections may move. For example, FIG. 16B shows that the surface remains symmetrical as it moves in towards an interior of container 1000 as compared to FIG. 16A. Portion 1600 moves in towards the interior of container by the most as compared to portions 1601 and 1602. In other words, a first portion of the surface moves towards the interior of container 1000 more than a second portion of the surface.

Additionally, as first vacuum panel 410 flexes in towards the interior of container 1000, first vacuum panel 420 also twists. A twist may be characterized as an un-symmetrical concave shape. For example, in FIG. 16B, portions 1601 and 1602 are symmetrical along an imaginary vertical axis at 1600. However, FIG. 16C, while also more concave than FIG. 16A, is not symmetrical along an imaginary vertical axis draw at 1600. Rather, 1602 has moved in towards the interior of container 1000 by a greater distance than portion 1600 and 1601. The difference is more pronounced in FIGS. 16D. FIGS. 16E-16F show surfaces where portion 1601 has moved in more than 1600 and 1602. While FIGS. 16B-16F show surfaces that have increased in concavity as compared to surface in FIG. 16A, the twist of these surfaces are different from each other.

A twist may also be characterized as a horizontal cross section changing shape in a different way than other horizontal cross sections, which is shown in FIGS. 14A-14C and 15A-15B. In FIGS. 14B-14C and 15A-15B, shade lines indicate the amount of twisting that is present. Shade lines that are closer together indicate a portion of first vacuum panel 410 that has not flexed in towards the interior of the container relative to shade lines that are further apart. Thus, in FIG. 14B, for example, the upper-right hand corner and lower-left hand corner of first vacuum panel 410 have flexed further in towards the interior of container 1000 relative to the lower-right hand corner and upper left-hand corner. FIGS. 16A-16F show how different horizontal cross sections may change shape in different ways. For example, the surface of first vacuum panel 410 at horizontal cross section E-E in FIG. 3 may look like FIG. 16D while the surface of first vacuum panel 410 at cross section F-F may look like FIG. 16F after deformation. Additionally, in some embodiments, the surface of first vacuum panel 410 at horizontal cross section A-A in FIG. 3 may look like FIG. 16B.

As shown in FIG. 13A, as second vacuum panel 420 experiences stress, the shapes of upper surface 4201 and lower surface 4200 of second vacuum panel 420 also change in different ways. For example, in some embodiments, lower surface 4200 near base 420B increases in concavity as the internal pressure of container 1000 changes while upper surface 4201 does not. This is shown in FIGS. 13A-13C. This is also shown in FIGS. 12A-12G where line 401E (420) increases in curvature.

Additionally, as third vacuum panel 421 experiences stress, the shapes of upper surface 4210 and lower surface 4211 also change in different ways. For example, in some embodiments, upper surface 4210 near base 421B increases in concavity as the internal pressure of container 1000 changes while lower surface 4211 does not. This may be due to the fact that is oriented in an opposite direction than second vacuum panel 420.

A comparison between the stresses on second vacuum panel 420 and deformation of the surfaces of second vacuum panel 420 show that the amount of deformation or change in shape is not proportionate to the stress that is on the surface of second vacuum panel 420.

In some embodiments, container 1000 may return to its original shape when the lid 600 is removed from neck portion 200 and the seal is released. This is due to the characteristics of the body portion 400 and vacuum panels 410, 420, and 421. Not only are vacuum panels 410, 420, and 421 easily deflectable, but they also do not retain their deflected shape. The vacuum panels, especially first vacuum panel 410, remains flexible after flexing so that it may flex outwards once container 1000 is opened. First vacuum panel 410, second vacuum panel 420, and third vacuum panel 421 may be formed of a thermoplastic polymer resin, like PET (polyethylene terephthalate). Other suitable thermoplastic resins are also envisioned, like bioplastics such as PEF (polyethylene furanoate).

In some embodiments, body portion 400 and may also be shaped to allow gripping and squeezing of the container by a consumer. For example, in some embodiments, first vacuum panel 410 may have spaced-apart ribbed portions, as seen in FIG. 1 to help with grip and friction. In embodiments with two first vacuum panels that are diametrically opposed, both first vacuum panels 410 have ribbed portions to accommodate the user's thumb and the user's four fingers.

The present invention has been described above with the aid of functional building blocks illustrating the implementation of specified functions and relationships thereof. The boundaries of these functional building blocks have been defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

Further, references herein to "some embodiments," "one embodiment," "an embodiment," "an example embodiment," or similar phrases, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein.

What is claimed is:

1. A container comprising a body portion, wherein the body portion comprises:

two diagonal pressure accommodation areas;

a first triangular area;

a second triangular area; and at least one column between each diagonal pressure accommodation area and triangular area, wherein each diagonal pressure accommodation area includes an upper portion, a central portion, and a lower portion, wherein, when the container is sealed, each diagonal pressure accommodation area is configured to twist in response to a change in pressure within the container, wherein the upper portion, the central portion, and the lower portion of each diagonal pressure accommodation area are vertically offset from each other, and each are configured to curve in towards an interior of the body portion in response to a change in pressure within the container, and wherein a horizontal cross-section of the upper portion and a horizontal cross-section of the lower portion each have a more asymmetrical curvature than a horizontal cross-section of the central portion.

2. The container of claim 1, wherein each diagonal pressure accommodation area comprises a grip region.

3. The container of claim 2, wherein the grip regions include spaced-apart ribs.

4. The container of claim 1, wherein the two diagonal pressure accommodation areas each have a height greater than a height of the first triangular area and a height of the second triangular area.

5. The container of claim 1, wherein the first triangular area comprises a base and the second triangular area comprises a base, and wherein a distance measured from the base of the first triangular area to the base of the second triangular area is at least one-third a total height of the container.

6. The container of claim 1, wherein the container has an oval horizontal cross section at a position intersecting the two diagonal pressure accommodation areas, the first triangular area, and the second triangular area.

7. The container of claim 1, wherein a first of the two diagonal pressure accommodation areas is disposed horizontally next to the first triangular area, wherein the first triangular area is disposed horizontally next to the second triangular area, and wherein the second triangular area is disposed horizontally next to a second of the two diagonal pressure accommodation areas.

8. The container of claim 1, wherein, in response to a change in internal container pressure, the container flexes at the first triangular area such that a surface of the first triangular area increases in concavity in response to an increasing pressure change.

9. The container of claim 1, further comprising:

a shoulder portion;

a base portion; and wherein the body portion is disposed between the shoulder portion and the base portion, wherein the container deforms in response to stresses on the container caused by a change in pressure within the container, and wherein at least 90% of a decrease in volume of the container is due to deformation of the body portion.

10. A container for storing a liquid filled in a hot state and then sealed, the container comprising:

a first vacuum panel having a first shape;

a second vacuum panel having a second shape that is the same as the first shape, wherein the second vacuum panel is oriented in an opposite direction than the first vacuum panel; and a third vacuum panel having a third shape that is different from the first shape, wherein the first vacuum panel, the second vacuum panel, and the third vacuum panel are disposed horizontally next to each other, wherein, in response to a reduction in volume when the container is sealed, the container is configured to twist to accommodate the reduction in volume.

11. The container of claim 10, wherein the twist is initiated by cooling of the liquid.

12. The container of claim 10, wherein the first shape is triangular, the second shape is triangular, and the third shape is diagonal.

13. The container of claim 10, wherein the first vacuum panel is disposed between the second vacuum panel and the third vacuum panel such that sides of the first vacuum panel align with sides of the second vacuum panel and the third vacuum panel.

14. The container of claim 10, wherein a height of the third vacuum panel is greater than a height of the first vacuum panel and a height of the second vacuum panel.

15. The container of claim 10, wherein both the first vacuum panel and the second vacuum panel are disposed between upper and lower extents of the third vacuum panel.

16. A container comprising:

a first diagonal pressure accommodation area;

a second diagonal pressure accommodation area;

a first triangular area;

a second triangular area;

a first column between the first diagonal pressure accommodation area and the first triangular area; and a second column between the second diagonal pressure accommodation area and the second triangular area, wherein a height of the first diagonal pressure accommodation area is greater than a height of the first triangular area, and wherein, when the container is sealed, the first diagonal pressure accommodation area and the second diagonal pressure accommodation area each twist in response to a change in pressure within the container.

17. The container of claim 16, wherein the first diagonal pressure accommodation panel is disposed horizontally next to the first triangular area, and wherein the first triangular pressure accommodation panel is disposed horizontally next to the second triangular pressure accommodation panel.

18. The container of claim 16, further comprising:

a third triangular area; and a fourth triangular area disposed horizontally next to the third triangular area.

19. The container of claim 16, wherein the first diagonal pressure accommodation area and the second diagonal pressure accommodation area are disposed on opposite sides of the container.

20. The container of claim 16, wherein the first diagonal pressure accommodation area and the second diagonal pressure accommodation area are the only diagonal pressure accommodation areas of the container.

* * * * *